US005472191A

United States Patent [19]

Hendricks

[11] Patent Number: 5,472,191

[45] Date of Patent: Dec. 5, 1995

[54] BASKETBALL BOARD GAME

[76] Inventor: Luke L. Hendricks, 25771 Juniper Ave., New Prague, Minn. 56071

[21] Appl. No.: 94,686

[22] Filed: Jul. 19, 1993

[51] Int. Cl.[6] ..... A63F 7/06

[52] U.S. Cl. ..... 273/85 R; 273/244; 273/259; 364/410

[58] Field of Search ..... 273/243, 244, 273/85 R, 259, 1.5 R; 364/410, 411, 412

[56] References Cited

U.S. PATENT DOCUMENTS

| | | | |
|---|---|---|---|
| 1,115,893 | 11/1914 | Briare . | |
| 1,458,275 | 6/1923 | Cossitt . | |
| 1,594,807 | 8/1926 | Wurth . | |
| 2,261,448 | 11/1941 | Petersen | 273/244 |
| 2,886,319 | 5/1959 | Henderson . | |
| 3,545,763 | 12/1970 | Seitz . | |
| 3,853,322 | 12/1974 | Mercer | 273/244 |
| 3,941,386 | 3/1976 | Nelson . | |
| 4,186,928 | 2/1980 | Hunt, Jr. . | |
| 5,123,653 | 6/1992 | Murphy | 273/244 |
| 5,129,651 | 7/1992 | Tobias | 273/244 |

*Primary Examiner*—Sebastiano Passaniti

*Attorney, Agent, or Firm*—Merchant, Gould, Smith, Edell, Welter & Schmidt

[57] ABSTRACT

A basketball board game includes a game board divided into shooting areas associated with the symbol. Player figures are located on the board within the shooting areas. A shot matrix is provided together with a probabilistic generator to determine a player making or missing a shot.

13 Claims, 29 Drawing Sheets

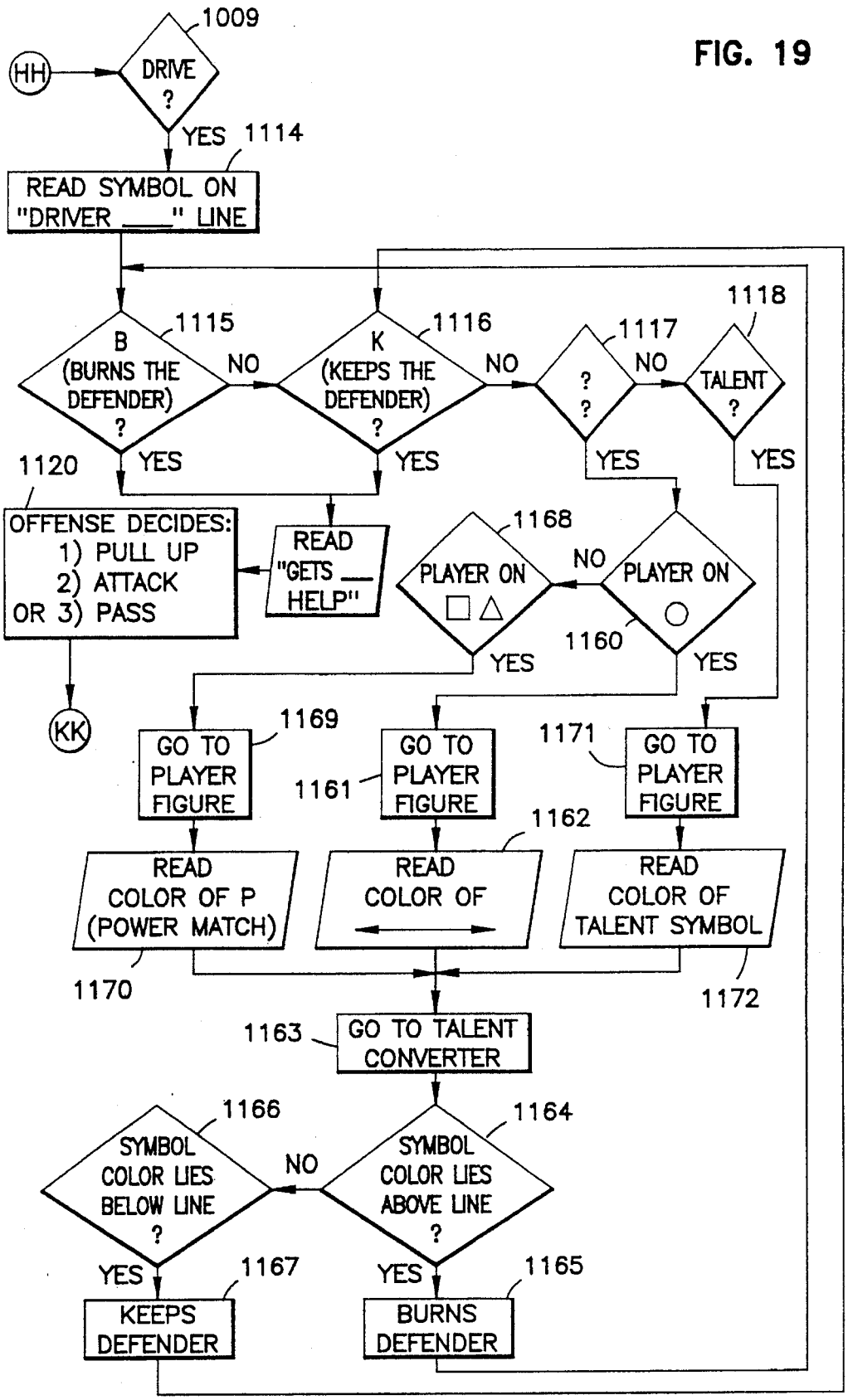
FIG. 19
HH
1009
DRIVE ?
YES
1114
READ SYMBOL ON "DRIVER ___" LINE
1115
B (BURNS THE DEFENDER) ?
NO
1116
K (KEEPS THE DEFENDER) ?
NO
1117
? ?
NO
1118
TALENT ?
YES
YES
YES
YES
1120
OFFENSE DECIDES: 1) PULL UP 2) ATTACK OR 3) PASS
READ "GETS ___ HELP"
1168
PLAYER ON □ △
NO
PLAYER ON ○
1160
YES
YES
KK
1169
GO TO PLAYER FIGURE
1161
GO TO PLAYER FIGURE
1171
GO TO PLAYER FIGURE
1162
READ COLOR OF P (POWER MATCH)
READ COLOR OF ←→
READ COLOR OF TALENT SYMBOL
1170
1172
1163
GO TO TALENT CONVERTER
1166
SYMBOL COLOR LIES BELOW LINE ?
NO
1164
SYMBOL COLOR LIES ABOVE LINE ?
YES
1167
YES
1165
KEEPS DEFENDER
BURNS DEFENDER

BASKETBALL BOARD GAME

FIELD OF THE INVENTION

The present invention relates to a board game for simulating a basketball game. The invention provides for determining whether players make or miss shots based on comparison of a number representing statistical past performance with a number determined by a means of chance. The "hot hand" phenomenon is incorporated and provides for a player's chances of making a shot to increase upon successful completion of a previous shot and vice versa. Various pieces of equipment of the game cooperate to determine the outcome of various actions chosen by the players of the game.

BACKGROUND OF THE INVENTION

In real-life basketball, there is believed to exist a phenomenon identified as "the hot hand". This occurs when a player shoots particularly well during a given period (i.e. a "hot streak"). That is, the player makes a greater percentage of shots than would be anticipated during a given time. Conversely, a player may have a cold hand and make a lesser percentage of shots during a given time than the player's statistics would predict. This "hot hand" phenomenon can affect coaching and player decisions as to which player should be given the ball to attempt a shot. Therefore, it would be desireable to provide a board game that simulates a basketball game and allows for the hot hand effect.

Additionally, it would be desireable to provide a board game that allows players to function in the roles of player, coach and announcer of a basketball game, and provides various pieces of game equipment which cooperate to determine the outcome of actions chosen by the players of the board game.

SUMMARY OF THE INVENTION

This invention relates to a basketball board game including a game board which depicts a basketball court divided into a plurality of shooting areas, with each shooting area being associated with a symbol. Player figures representing actual basketball players are selectively located on the board within the defined shooting areas. A shot matrix associated with each player figure is provided. Each shot matrix has a plurality of columns and rows, with each shooting area being associated with one row. Further, each row contains one number in each column. One of the columns is selectively identified as a designated column and one row is identified as a shooting row. The shooting row is determined by location from which a player figure is designated to shoot. Means of chance are provided for determining a base number, such that during play to determine whether a player figure makes or misses a basket, the base number as given by the means of chance can be compared to the number on the associated shot matrix lying within the shooting row in the designated column.

This invention further relates to a basketball board game comprising a game board depicting a basketball court with a plurality of symbols thereon to designate various shooting areas. A shot matrix for use in determining whether a player makes a shot from a predetermined shooting area is provided. The matrix includes a plurality of rows and columns, which carry numbers and symbols, with each of the rows being associated with one shooting area and being labeled with the symbol for the associated shooting area.

This invention further relates to a basketball board game including player figures which represent basketball players. The player figures carry a plurality of symbols which represent basketball playing skills, and each symbol is shaded a prescribed color to represent the relative level of the player's aptitude for that associated skill. Means are provided for specifying one of the symbols to be used to determine the results of an action taken by a basketball player during play of the game. Means for determining the outcome of the action using the color of the specified symbol is provided.

This invention further relates to a method of determining whether a basketball player makes or misses a shot during play of a basketball game including the steps of providing a game board which depicts the basketball court divided into a plurality of shooting areas, with each shooting area labeled with a symbol. Player figures are provided which represent basketball players, and each of the player figures are located within one shooting area. One shooting player is identified to attempt to shoot a basket. A shot matrix is provided that is associated with that player. The matrix has a plurality of columns and rows. Each shooting area is represented in association with one row, and that one row is labeled with the symbol associated with the shooting area. Each row contains one number in each column. One of the columns is identified as a designated column, and one row is associated with the shooting area of the shooting player is identified as a shooting row. The method further includes the step of providing means for selecting a number by chance and activating the chance means to select a base number. The method further includes the comparison of the base number with the number located in the designated column in the shooting row to determine whether a shot is made or missed. Finally, after the previous step, the method comprises the step of identifying another of the columns as the designated column, that identification being dependent upon whether the shot is indicated made or missed.

Finally, this invention relates to a method of playing a simulated basketball game comprising the steps of providing a game board depicting the basketball court; providing player figures representing basketball players; providing means for selectively determining the odds of each player making a shot; providing means of changing those odds; providing means of chance for use in selecting a base number; providing comparison means for determining whether a player has made a shot, the comparison means specifying which numbers generated by the means of chance represent made shots and which numbers represent missed shots; identifying one shooting player figure to attempt to shoot a basket; activating the means of chance to generate a base number; determining whether a player has made a shot as determined by the base number generated by the means of chance and by the comparison means; and after the previous step, if the player has made the shot, increasing the odds of that player making the next shot or if the player misses the shot, decreasing the odds of that player making the next shot.

BRIEF DESCRIPTION OF THE DRAWINGS

In the drawings, in which like reference numerals indicate corresponding parts through several view:

FIGS. 11, 12, 12*a*, 13–20, 20*a*, 21–28 illustrate a flow chart for a preferred embodiment of a board game according to the present invention.

DETAILED DESCRIPTION OF THE PREFERRED EMBODIMENT

The present invention relates to a basketball board game to be played by two players. The game allows the two game players to act in the roles of coach, player, and announcer, for a simulated basketball game. For convenience, throughout this description, the players of the board game will be identified as "coaches", so as to distinguish them from the basketball players in the simulated basketball game.

The game provides for the coaches to make personnel and playing decisions, using equipment associated with the game to govern the outcome of the actions chosen by the coaches.

A preferred embodiment of this game is as a board game. However, it is noted that an electronic game can be provided within the spirit of this invention.

I. The Game Equipment

Figure 1:
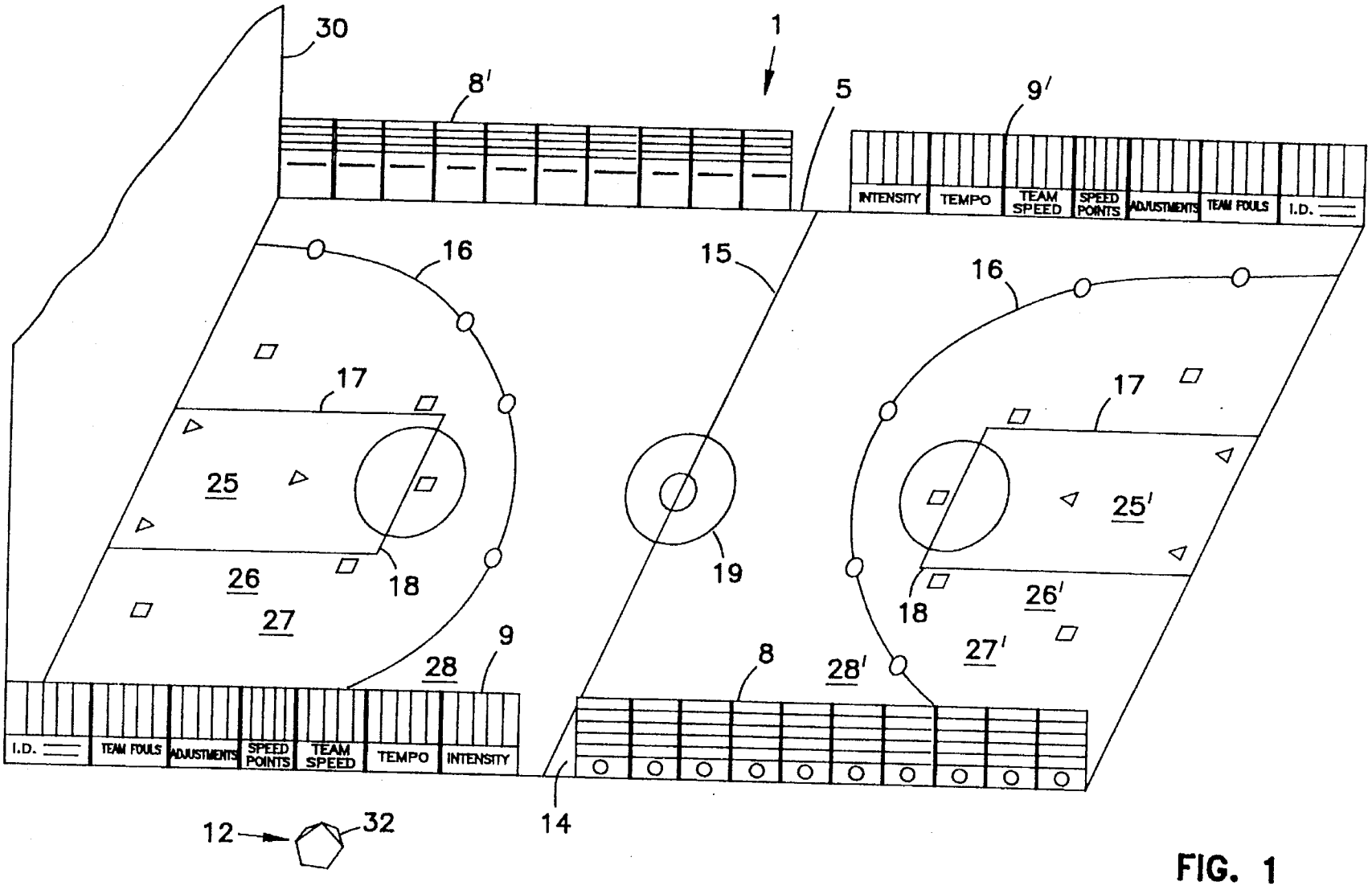
FIG. 1 illustrates a game board for use in conjunction with a board game according to the present invention.
Figure 5:
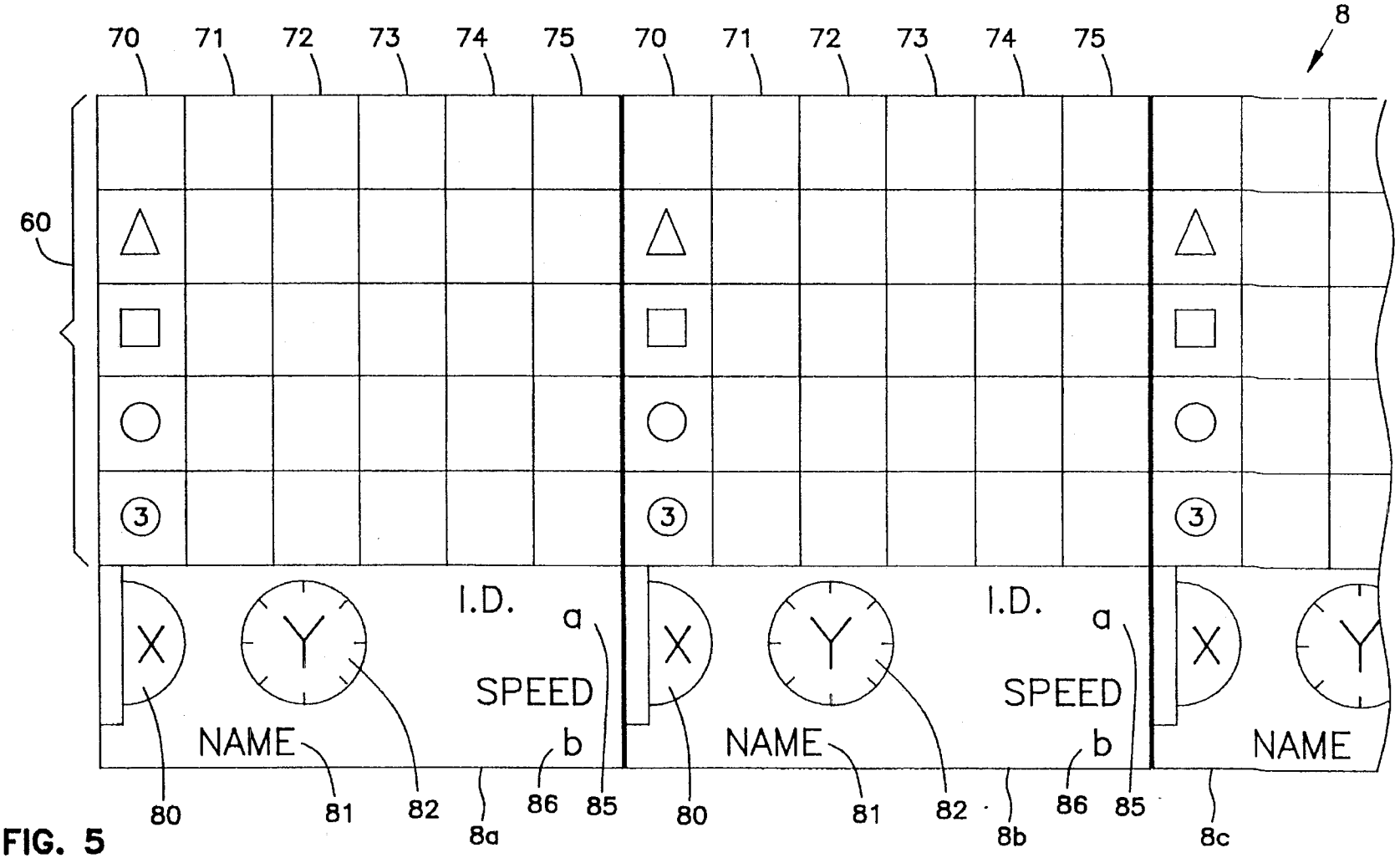
FIG. 5 illustrates a shot matrix strip for use in conjunction with a board game according to the present invention.
Figure 6:
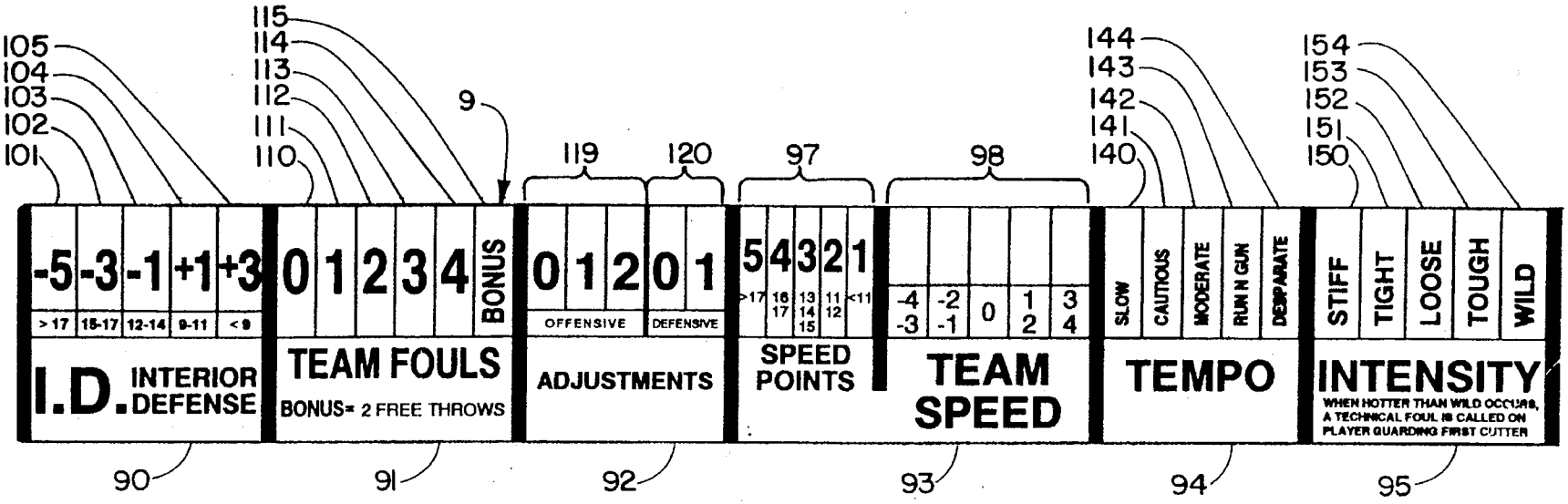
FIG. 6 illustrates a coaching parameter panel for use in conjunction with a board game according to the present invention.
Figure 7:
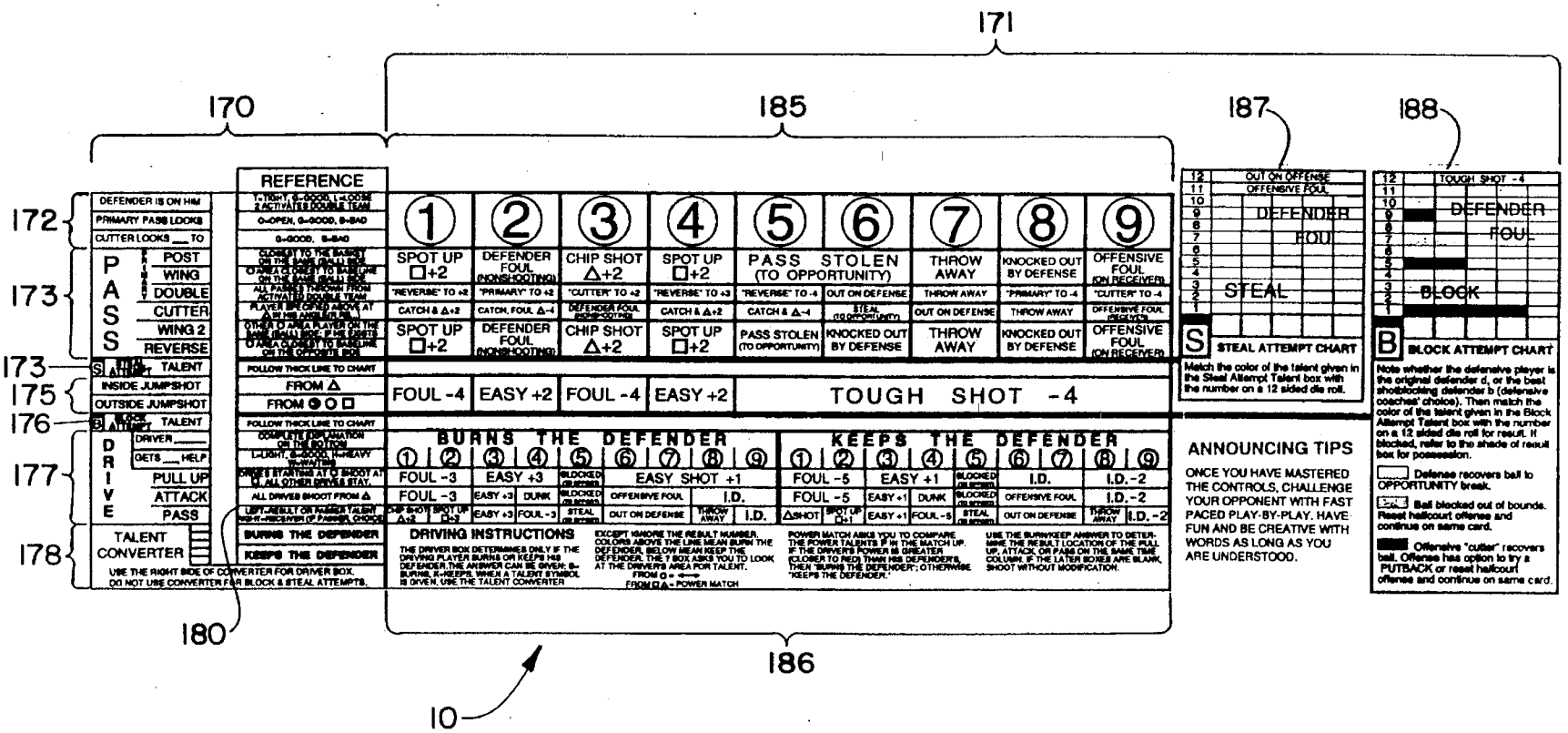
FIG. 7 illustrates a play template for use in conjunction with a board game according to the present invention.
Figure 8:
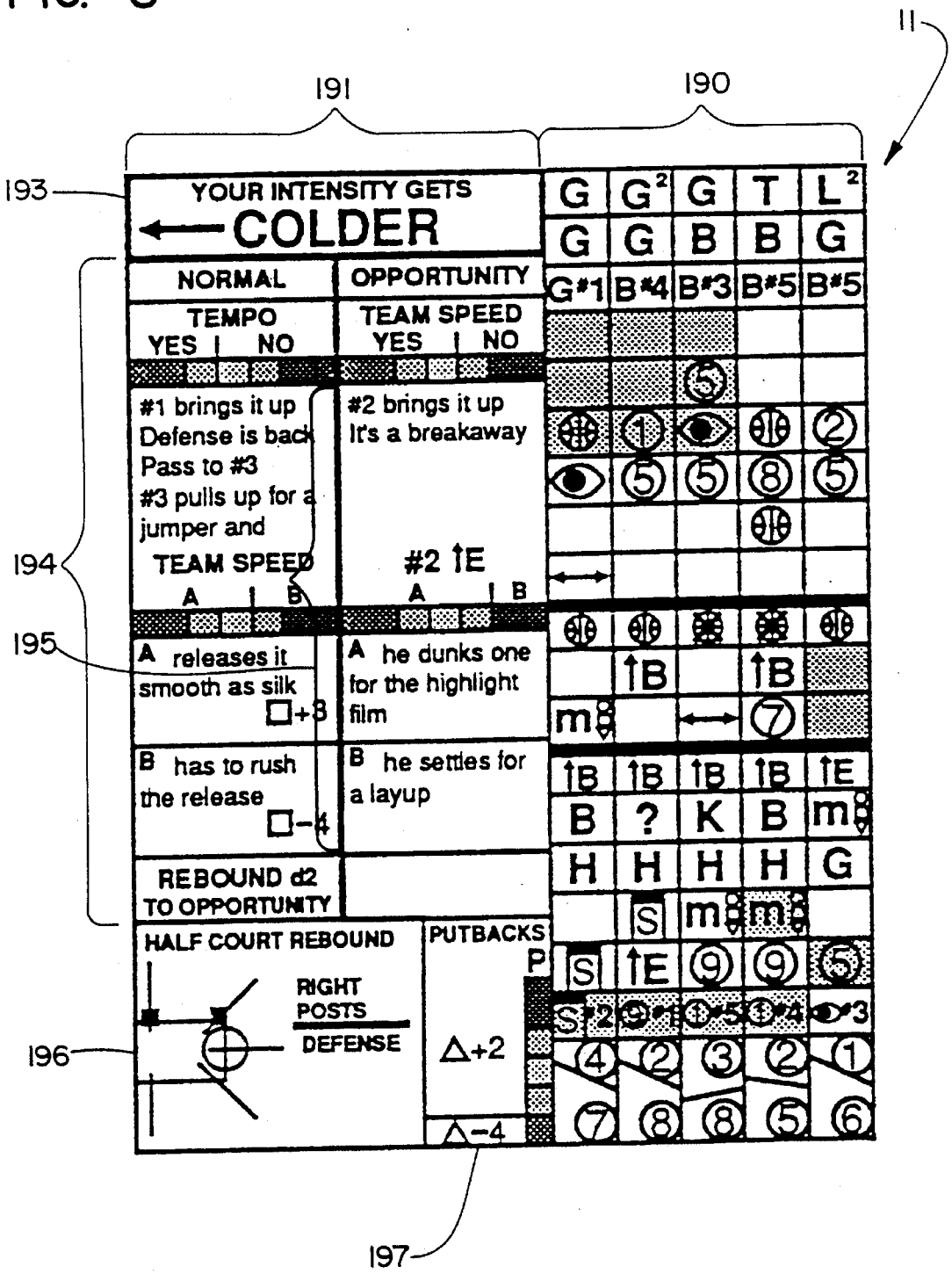
FIG. 8 illustrates a play card for use in conjunction with a board game according to the present invention.

A preferred embodiment of a basketball board game 1 according to the present invention includes a number of pieces of equipment: a game board 5 depicting a basketball court (FIG. 1); offensive and defensive player FIGS. 6 and 7, respectively (FIGS. 2 and 3, respectively); a shot matrice strip 8 containing a plurality of shot matrixes 8*a–e* (FIGS. 4 and 5) associated with each player represented by a player figure; a coaching parameter panel 9 (FIG. 6); a play template 10 (FIG. 7); a plurality of play cards, such as the play card 11 illustrated in FIG. 8; means of chance 12, such as the 12-sided die illustrated in FIG. 1; and specialty cards (not illustrated).

The board 5, illustrated in FIG. 1, depicts a representation of a basketball court, with typical court markings thereon. These markings include the mid-court line 15, the three-point lines 16, the lanes 17, the free throw lines 18 and center-court markings 19. Reference numeral 14 indicates the entire court. The court 14 is divided into two identical halves by half-court line 15. Each half is divided into generally four shooting areas, defined according to distance from the imaginary basket. A first area 25 is closest to the basket; a second area 26 is farther from the basket; area 27 is still farther from the basket, and area 28 is beyond the three-point line. In the preferred embodiment of this game, there are symbols associated with each of these areas located on the board 5. The triangle (Δ) symbol is associated with the first area 25, and triangles (Δ) are marked on the board 5 within first area 25. A square (□) is associated with second area 26. Five squares are drawn on board 5 within area 26. The circle (○) is associated with the third area 27. Six circles (○) are marked at various points on the board 5 within area 27. The preceding discussion describes one half of the court. It should be understood that the other half of the court is similarly arranged and marked. Analogous court features are given analogous reference numbers, with a prime (') added to the numerals for the features of the other end of the court. For example, similar shooting areas 25'–28' are provided, and are illustrated by triangles, squares, and circles as described above with respect to the first end of the court.

For aesthetics, an end board 30 can be provided at each end of the court, carrying illustrations of a basket, a crowd scene, scoreboards, or the like.

Along each sideline is arranged a shot matrice strip 8, 8', and a coaching parameter panel 9, 9'. Preferably, the shot matrice strip 8, 8' and the coaching parameter panels 9, 9' are self-supporting and stand vertically. The information presented on the coaching panel is printed on both sides, so that both players are able to read both their own and the opposing team's coaching parameter panels 9, 9'. Only portions of the information conveyed by the shot matrice strip 8, 8' are visible from the back side of the shot matrice strip 8, 8', as will be discussed further below.

As noted above, means of chance 12 is provided. In a preferred embodiment, a 12-sided die 32 is used as the chance means. For convenience, a 12-sided die may be provided for each coach.

Figure 2:
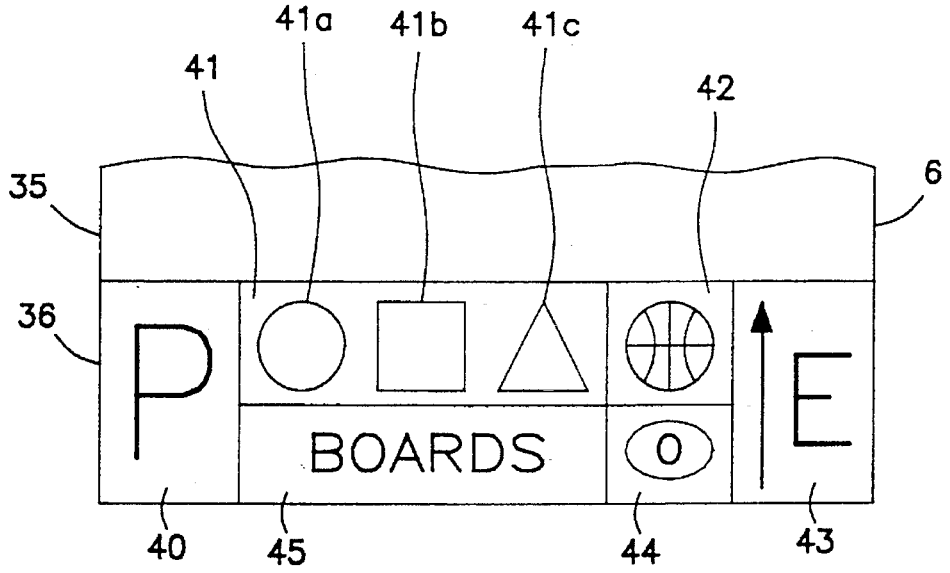
FIG. 2 illustrates an offensive player figure for use in conjunction with the board game according to the present invention.
Figure 3:
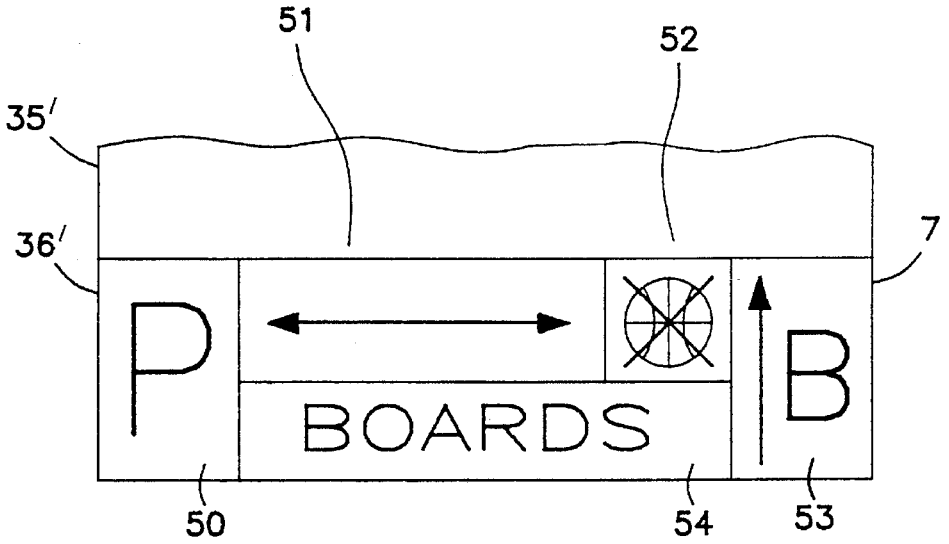
FIG. 3 illustrates a preferred embodiment of a defensive player figure for use in a game according to the present invention.

The game 1 includes a plurality of player FIGS. 6, 7, such as those illustrated in FIGS. 2 and 3. In a preferred embodiment, each game 1 includes player FIGS. 6, 7 representing and depicting actual players. The players preferably represent players in the National Basketball Association (NBA), though they may represent players from other basketball organizations, such as college teams or professional associations in other countries. Each coach chooses which NBA team he/she wishes to "coach", and then selects those players from that team that he/she wishes to have on the court at any particular time.

For each actual NBA player, there exist two player FIGS. 6, 7. One player figure represents that NBA player on offense 6, FIG. 2, and a second player FIG. 7 represents that same NBA player on defense, FIG. 3.

Each player FIGS. 6, 7 includes generally two sections. One section 35, 35', carries a likeness of the player. A second portion 36, 36' of the player FIGS. 6, 7 presents information regarding skills that that player has. (As will be discussed further below, information provided with respect to player skills is preferably consistent with the actual performance of that NBA player, as determined by scouting information regarding that player's particular talents.)

Each offensive player FIG. 6 has locations for conveying information regarding the relative skill level of a player for the following skills: power 40, moves 41, ball control ability 42, elevation (vertical leap combined with height) 43, court sense 44, and rebounding ability 45. More specifically, area 41 is divided into three areas which convey information regarding the player's moves within the third shooting area 27, the second shooting area 26, and the first shooting area 25, as indicated by reference numerals 41*a*, 41*b*, and 41*c*, respectively, in FIG. 2.

Each defensive player FIG. 7 includes locations for conveying information regarding the player's skill for the following skills: power 50, lateral movement 51, ball stealing ability 52, shot blocking ability 53, and rebounding ability 54.

In a preferred embodiment, the information on both the offensive and defensive player figures is conveyed by color-coded symbols. However, other means of conveying relative skill levels are contemplated, such as numerical values representing relative skill level. This will be discussed in greater detail below.

Figure 4:
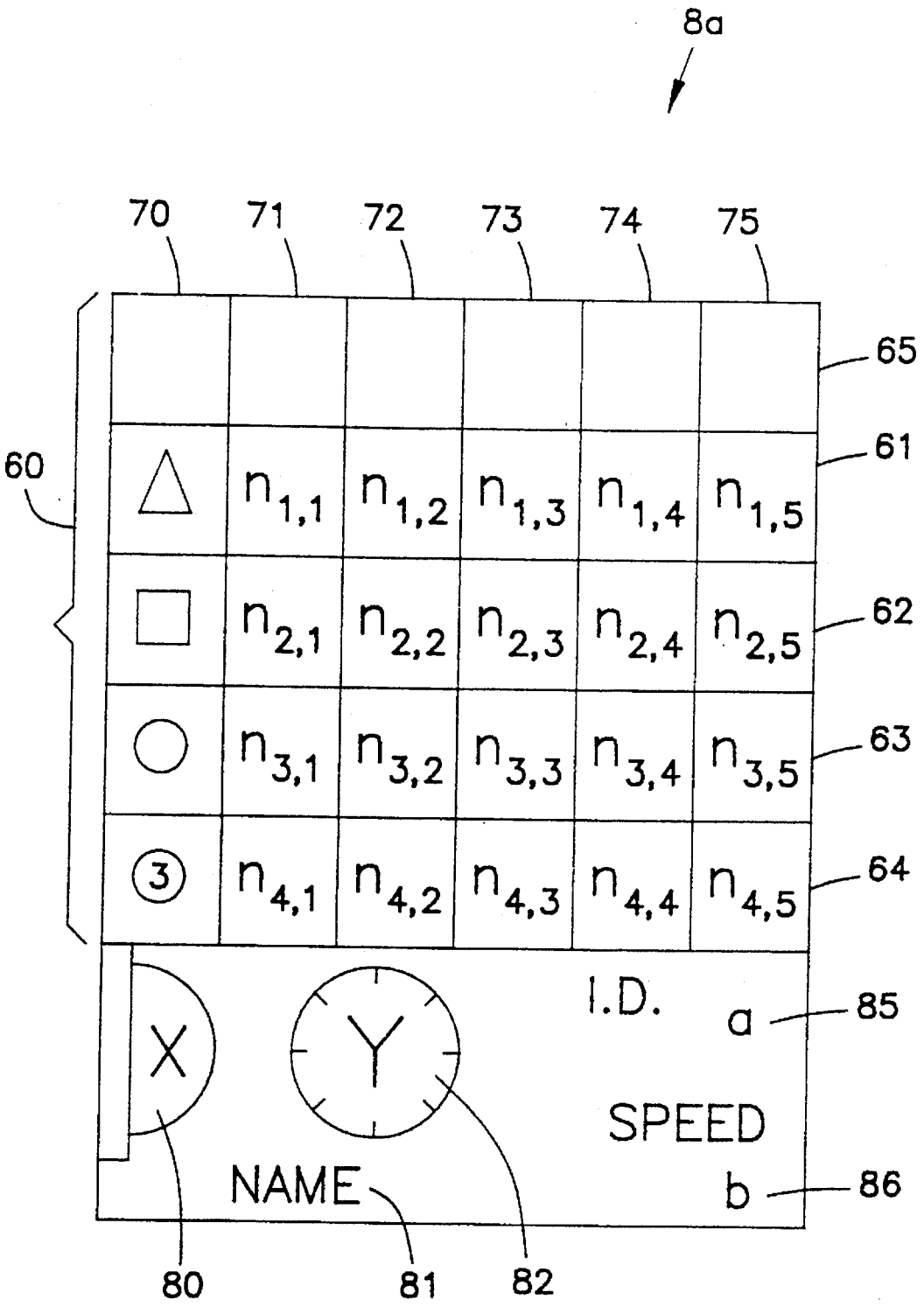
FIG. 4 is a schematic illustration of a shot matrix for use in conjunction with a basketball board game according to the present invention.

The shot matrice strip 8 is composed of a plurality of shot matrices 8*a*–8*d*, illustrated in FIGS. 4 and 5. FIG. 4 is a schematic illustration of a single shot matrix. Traditional matrix notation is used. For example, $n_{1,1}$ indicates a numeral located in a first row and first column. Similarly, $n_{1,2}$ indicates a numeral located in a first row and in a second column. $n_{2,1}$ indicates a numeral in the second row and first column. The matrix illustrated is a 4×5. FIG. 5 shows how a series of shot matrices 8*a*–8*d* are strung together to form a shot matrice strip 8. Each shot matrix 8*a*, 8*b*, 8*c*, 8*d*, and 8*e*, corresponds to one player represented by a player FIGS. 6, 7.

Turning again to FIG. 4, each shot matrix 8*a*–8*d*, includes locations for conveying various information. A shot probability section 60 carries the true matrix portion of the shot matrix 8*a*. It includes four rows 61–64, each associated with one shooting area. Specifically, row 61 is associated with the triangle (Δ) shooting area 25; row 62 is associated with the square (□) or second shooting area 26; row 63 is associated with the circle (○) or third shooting area 27; and row 64 is associated with shooting area 28, or the three-point shooting area. A fifth row 65 at the top of the shot matrix 8*a* is an extension area for receiving a marker, such as a plastic clip or the like. The purpose for the marker or plastic clip will be discussed further below. The probability section 60 of shot matrix 8*a* is divided generally into six columns. Column 70 provides the labels for each of rows 61–64. Columns 71–75 and rows 61–64 provide locations for numerals which relate to the probability of a player making a basket from a particular location on the court. This will be described in greater detail below.

Each shot matrix 8*a*–8*d* further includes an area 80 for providing information regarding the probability of a player figure making a free throw. An area 81 is provided for the name of the player figure. Area 82 provides information regarding the number of time periods that that player can play consecutively (i.e. effectively a stamina quotient). Additionally, shot matrix 8*a* includes an area 85 for providing information regarding the player figure's interior defense ability. Finally, each shot matrix 8 includes an area 86 for providing information regarding the player's contribution to team speed.

FIG. 6 illustrates a coaching parameter board 9. Coaching parameter board 9 is divided into six sections. Section 90 is directed to interior defense; section 91 is directed to team fouls; section 92 is directed to adjustments; section 93 is directed to speed; section 94 is directed to tempo; section 95 is directed to intensity. The speed section 93 is divided into two subsections; subsection 97 is directed to speed points and subsection 98 is directed to team speed.

Interior defense section 90 is provided with five columns 101–105. Each column corresponds to a level of ability or skill of the team on the court for interior defense. A marker, such as a plastic clip attached to the top edge of coaching parameter board 9 is provided to indicate what level of interior defense a team has for the players on the court at any given time. The interior defense level is determined using the information provided in the interior defense section 85 of shot matrix 8. In a preferred embodiment, columns 101–105 are color-coded, with column 101 being blue, column 102 being green, column 103 being yellow, column 104 being orange, and column 105 being red.

Turning to the team fouls section 91 of the coaching parameter board 109, six columns are provided 110–115. Each column is associated with a number of team fouls. In the embodiment illustrated, column 110 is associated with zero team fouls, column 111 is associated with one team foul, and so forth up to column 115 which is associated with five team fouls. A marker, such as a plastic clip attached to the top edge of coaching parameter board 9 is provided to conveniently mark the number of team fouls that the team has acquired during play of the game. Column 115 is associated with the word "bonus".

Section 92 is provided to keep track of adjustments (i.e. substitutions and re-positioning) that a coach makes during the game. The adjustment section is divided into two sections 119 and 120. One section 119 is for adjustments on offense, and section 120 is for adjustments on defense. The adjustment sections 119 and 120 are used to keep track of the number of adjustments each team has made on offense and defense.

Tempo 94 and intensity 95 are parameters that a coach chooses at the start of the game. The intensity changes throughout play of the game, as will be discussed further below.

Tempo section 94 has five columns 140–144. In the preferred embodiment, each column 140–144 is associated with a particular tempo: desparate 140, run n gun 141, moderate 142, cautious 143, and slow 144.

The intensity section 95 has five columns 150–154 corresponding to different levels of intensity. For example, "STIFF" corresponds with column 150; "TIGHT" corresponds with column 151; "LOOSE" corresponds with column 152; "TOUGH" corresponds with column 153; and "WILD" corresponds with column 154. These columns can be color-coded. In a preferred embodiment, stiff is blue, tight is green, loose is yellow, tough is orange and wild is red.

Section 93 is directed to speed, and includes two subsections as noted above. Subsection 97 is a five column section directed to speed points. Section 98 is a five column section directed to team speed. Team speed is determined by subtracting the opponents speed points (1–5 from item 97 in FIG. 6) from the other players speed points (1–5). The result (4 to –4) is found on the team speed color chart (item 98 in FIG. 6). Speed points are determined by adding the speed number shown on shot cards (FIG. 5) for the five active players then converting the total speed number to the speed point (1–5) on the coach panel (using field 97 of FIG. 6).

FIG. 7 illustrates play template 10. Generally, play template 10 includes generally two sections. A first section 170 defines or relates to activities and conditions during one player's possession of the ball. A second section 171 describes outcomes of various activities.

More specifically, the first three rows 172 in the possession activity section 170 describe conditions with which a player having the ball is faced. The remainder of the sections in possession activity section 170 are as follows: pass section 173, steal attempt section 174, jump shot section 175, block attempt 176, drive section 177, and talent converter 178. The meaning of these sections and how they operate, will be described further below. A window is defined immediately adjacent sections 172–178.

Outcome section 171 is divided into generally four sections. A first section 185 provides outcomes for passes and jump shots. A second portion of the outcome section 171 is section 186 which provides outcomes for drives. Subsection 187 defines outcomes for steals; and subsection 188 provides outcomes for block attempts.

An example of a play card 11 for use in a game according to the present invention is illustrated in FIG. 8. As noted above, each game 1 includes a plurality of game cards 11. The format from game card to game card is the same. However, there is considerable variation amongst the symbols given and the text thereon. Generally, each play card 11 has a possession side 190 and a transition side 191. The possession side 190 has a plurality of columns and a plurality of rows.

The transition side carries several different sections. Block 193 provides information regarding intensity changes. Section 194, entitled "NORMAL", provides narrative information regarding a normal transition. Section 195 provides text and information regarding an opportunity transition. Section 196 provides information regarding the outcome of a half-court rebound. section 197 provides information for determining the result of a putback.

Figure 9:
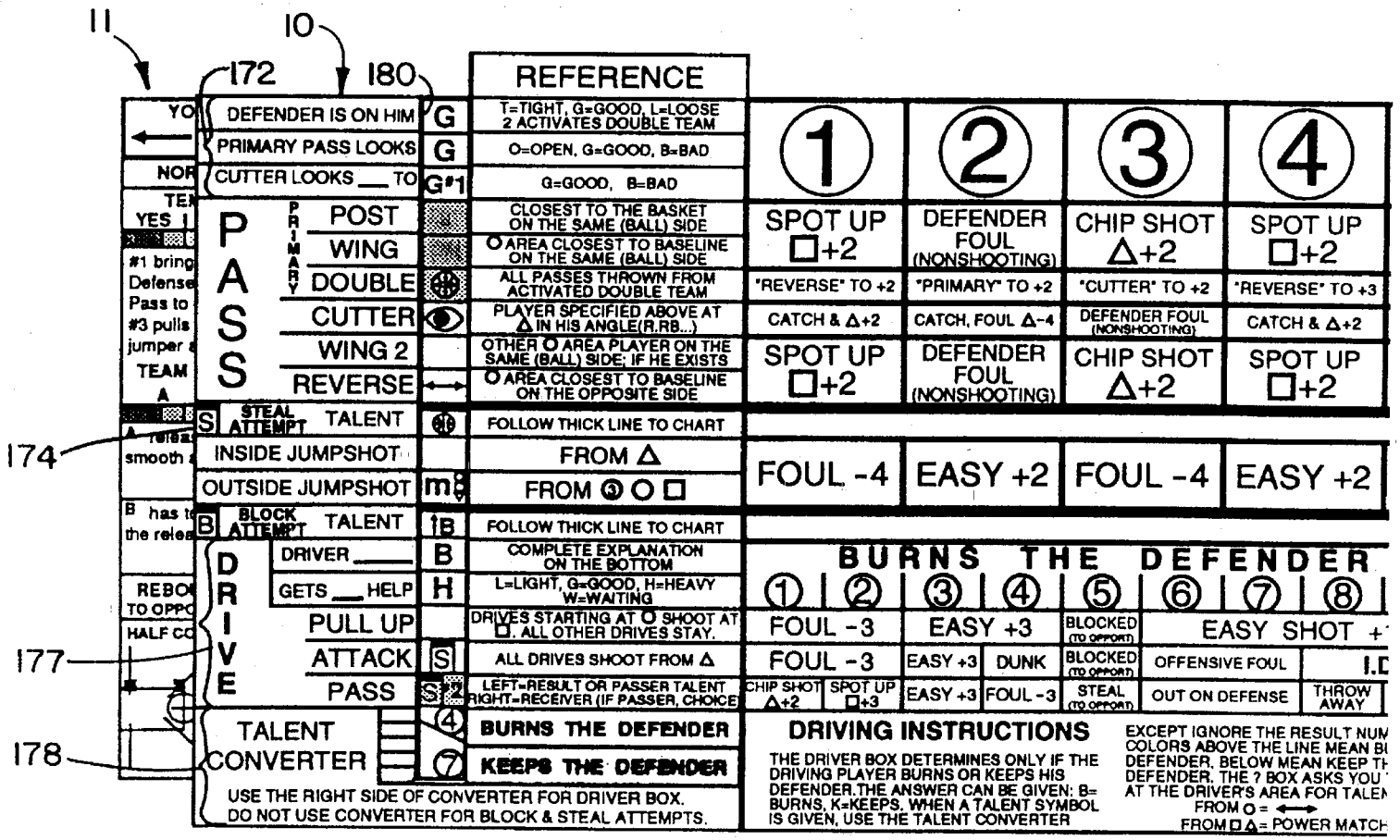
FIG. 9 illustrates a play card inserted in a plate template for use in conjunction with a board game according to the present invention.

As illustrated in FIG. 9, the play cards 11 are adapted to be used in conjunction with the play template 10. As illustrated, play card 11 is aligned with the window 180 in play template 10, such that one column of the possession side 190 of play card 11 is visible through window 180. It is the first column of play card 11 (from FIG. 8) that is visible in the window 180 of play card 10 in FIG. 9.

This has been a cursory overview of the equipment used in the preferred embodiment of a game 1 according to the present invention. This equipment, the information carried on the equipment, and the interaction amongst the various pieces will be described in greater detail below.

II. General Flow of Game

In this section, an overview of the play of the game is given. Greater detail of the flow of the game, and an example of play of the game will be found in Section IV.

To begin the game, each coach selects an NBA team which he/she wishes to coach. Each coach then selects those players which he/she wishes to begin play of the basketball game. The coach selects five players, and places the five offensive figures corresponding to those players at one end of the board. That is, one coach puts his/her five offensive players at one end of the board, and the other coach puts five of his offensive figures at the opposite end of the board. Each coach then determines appropriate defensive match-ups and places the five defensive figures corresponding to the five players he/she has selected next to the opposing offensive players. Thus, after setup, there are twenty player figures located on the board, representing ten players. The player figures are placed on the court at locations given by circle (○), square (□) or triangle (Δ) markings. More specifically, the coach for a first team ("Team A") will place five offensive figures at desired locations at one end of the court, with only one player located at any one circle, square, or triangle symbol. Then the coach for the other team ("Team B") will place one defensive player figure next to each of Team A's offensive player figures. Generally, during play, the player FIGS. 6, 7, are not physically moved about the board. Rather, the player FIGS. 6 and 7 remain on the location selected by the coaches. (Player FIGS. 6, 7 may be re-matched, or substituted through adjustments which will be discussed later.) As will be understood from the discussion below, an imaginary basketball is passed from player to player and moved about the court through word and thought.

The five players on the court are designated by numbers 1 through 5, typically with number 1 applying to the smallest player who typically plays outside, and number 5 applying to the larger players typically playing inside or center.

Each coach selects the appropriate shot matrice strip for the team he/she is coaching. From the information given on the shot matrice strip, each coach determines the team speed, interior defense, and speed points for his/her team, and positions markers on the coaching parameter panel 9 accordingly. Additionally, the coach selects an intensity and tempo for the game, and indicates the selected intensity and tempo by positioning markers on the coaching parameter panel 9.

The coach for Team A selects one player to take possession of the ball first. The coach for Team B draws one play card and inserts play card 11 into play template 10, such that the first column of possession side 190 of play card 10 is visible through window 180 of the play template 10. The coach for Team B reads the first three condition lines 172, using the information on play card 11 visible through window 180 to complete the conditions described on play template 10. For example, for the play card column visible in window 180 in FIG. 9, coach B would read "The defender is on him [the player having the ball] good; the primary pass looks good; and the cutter pass to player number one looks good." Based on this information, the coach for Team A will make a decision that the player having possession of the ball will either pass, shoot a jump shot, or drive. The coach for Team A announces his/her decision, and the coach for Team B reads the outcome of that action. The manner of interpreting the various outcomes is described in greater detail below. At this point, however, it is sufficient to understand that unless the outcome of a decision causes the defense, or Team B, to take possession of the ball (such as by stealing the ball or blocking a shot), the coach for Team A continues to make such decisions, and the coach for Team B continues to read the outcomes, until the outcome given is that a shot is to be taken by the player with the ball.

To determine whether a shot is made or missed, the coaches note the location from which the ball is being shot (i.e. from area 25, area 26, area 27, three-point area 28 or free throw). Then the coach for Team A rolls a 12-sided die. The number on the die is the "base number". This number is compared with the number given on the shooting player's shot matrix 8*a*–8*c*, as will be described in greater detail below. If the base number is less than or equal to the appropriate number on the shot matrix, then the shot is considered made. The other team then gets possession of the ball, and the process is repeated, with the coach for Team B making decisions as to whether to pass, shoot, or drive, and with the coach for Team A reading the conditions and outcomes.

If the shot by Team A was missed, however, there is a rebound by one of the teams as determined from the play card as will be described further below. If Team A gets the rebound, then Team A has the choice of shooting the ball again ("putback") or resetting and beginning their half-court offense again. If Team B gets the rebound, there is a transition situation, and the coach for Team B reads the transition side 191 of play card 10 to determine the outcome of the transition. As a general matter, a "transition" results when the defensive team (or Team B) gains possession of the ball, through a successful steal or getting a rebound. To determine the outcome of a transition possession, the coach for Team B reads the transition portion of the play card.

III. Shooting and "The Hot Hand" Phenomenon

The game 1 of the present invention incorporates or allows for the hot hand phenomenon, discussed above. Turning to the shot matrix illustrated in FIG. 4, five columns 71–75 are provided in association with four rows 61–64. Each row 61–64 corresponds to one shooting area 25, 26, 27, 28 (designated by Δ, □, ○, and three-point line) on the court 14. Each column is associated with a level of "hotness". In a preferred embodiment, a marker is provided, such as a plastic clip, that attaches to and slides along the top of the shot matrix 8 for each player figure's shot matrix, to keep track of a player figure's level of hotness. Numbers are provided at the locations indicated by matrix notation $n_{1,1}$, $n_{1,2} \ldots n_{4,5}$. These numbers determine the odds of a player making a shot from a particular location with a given level of hotness. The higher the hotness, the greater likelihood that a player will make his next shot. Thus, within each row, the numbers generally increase from the coldest column to the hottest column. (Recall that for the embodiment described, the number on the die is to be less than or equal to the number given on the shot matrix, for a player to make a shot. It is contemplated that for an alternative embodiment in which a player is defined to make a shot if the die number is greater than the shot matrix number, then the numbers on the shot matrix would decrease from the coldest column to the hottest.)

When play begins, each player FIGS. 6, 7 is assigned a neutral level of hotness—the centermost column 73. When a player makes a shot, that player becomes "hotter". The marker is then moved to the next hotter column. The next time the player shoots, the number against which the die roll number (i.e. the base number) is compared, will be greater. In this manner, the player's odds of making the next shot are increased, thus simulating the hot hand effect. Conversely, if a player misses a shot, the marker is moved to the next cooler column. The next time the player shoots, the number against which the die roll number (i.e. the base number) is compared will be lower. Thus, the player's odds of making the next shot are decreased.

It has been found that to roughly imitate real life shooting percentages, the numbers in a given row should not necessarily increase with every column. That is, two or more adjacent columns may carry the same numeral. However, the general trend from the coldest to hottest column is that the numbers increase.

For example, the following matrix roughly represents Scottie Pippin's (Chicago Bulls) actual shooting percentages from various areas of the court, based on past performance:

| | | | | | |
|---|---|---|---|---|---|
| | 4 | 5 | 5 | 7 | 7 |
| | 4 | 5 | 5 | 6 | 7 |
| | 1 | 3 | 3 | 4 | 4 |
| 3-point | 1 | 2 | 3 | 3 | 4 |

At the beginning of a game, Mr. Pippin's marker would be in the center column. If he were to shoot a shot from a triangle (Δ) area, he would make the shot if the die roll were less than or equal to five. If he were to make the shot, the marker would be moved to the next hotter column, column 74, which is second from the right. The next time he were to take a shot, column 74 would be used. That is, if he were to take a next shot from the triangle area, the die roll would be compared with the number six, and if the die number were less than or equal to six, he would make the shot. If, however, the die roll were greater than six, then the marker would be moved back to the center column 73.

IV. Relative Skill Levels of Players for Various Skills and the Outcome of Various Actions as Determined by Skill Level Both the player FIGS. 6, 7 and the shot matrices 8 contain information that reflects the relative ability of each player FIGS. 6, 7 for various basketball skills. Preferably, if the player FIGS. 6, 7 represent actual NBA players, the skill information reflects the NBA player's actual skill levels, as determined from statistics and/or scouting information regarding past performance.

As noted above, the numbers on the shot matrix columns reflect a range (hot to cold) of a player's ability to score from various court locations. The player's name is given at location 80. The shot matrix additionally includes a number at location 81 which is used, by comparison with a die roll number or base number, to determine if free throws are made, in the same manner as shots from other areas of the court. This number generally reflects the real life player's free throw shooting ability. The shot matrix further includes area 82 which dictates the number of time periods a player may play consecutively. This number reflects the real life player's stamina. Similarly, the numerals given at 85 and 86 reflect the real life player's ability for interior defense and speed, respectively.

On each player FIGS. 6, 7, additional information regarding the player's skill level for various skills is provided. In a preferred embodiment, this information is conveyed by color-coded symbols. For example, each offensive player FIG. 6 contains information regarding the following skills: power, moves at various areas of the court, ball handling, court sense, ability to leap vertically, and rebounding ability. The defensive player FIG. 7 contains information regarding the following skills: power, lateral movement, ball stealing ability, shot blocking ability, and rebounding ability.

These symbols are color-coded to indicate relative skill levels. In the preferred embodiment, a five-color system is used: red, orange, yellow, green, and blue. As a general matter, the red end of the spectrum suggests a relatively high level of skill and the blue end of the spectrum represents a relatively low level of skill. The colors of the symbols are used in conjunction with the play cards and templates to determine the outcome of some activities. More specifically, the color-coded symbols are used in conjunction with the play cards and the play template to determine the outcome of passes, steal attempts, jump shots, block attempts, and drives. Further, the color-coded symbols are used in conjunction with the play cards to determine the results of transition activity, rebounds and putbacks. Additionally, the tempo and intensity chosen by the coach and the team speed resulting from the individual player's contributions to the team speed quotient, correspond to a level given by a color that is used in conjunction with the play cards to determine the results of transition activity.

Of course, any color or shading system may be used to indicate various skill levels. In fact, means other than color for indicating levels can be used, such as numerals.

V. Examples of Play

Figure 10:
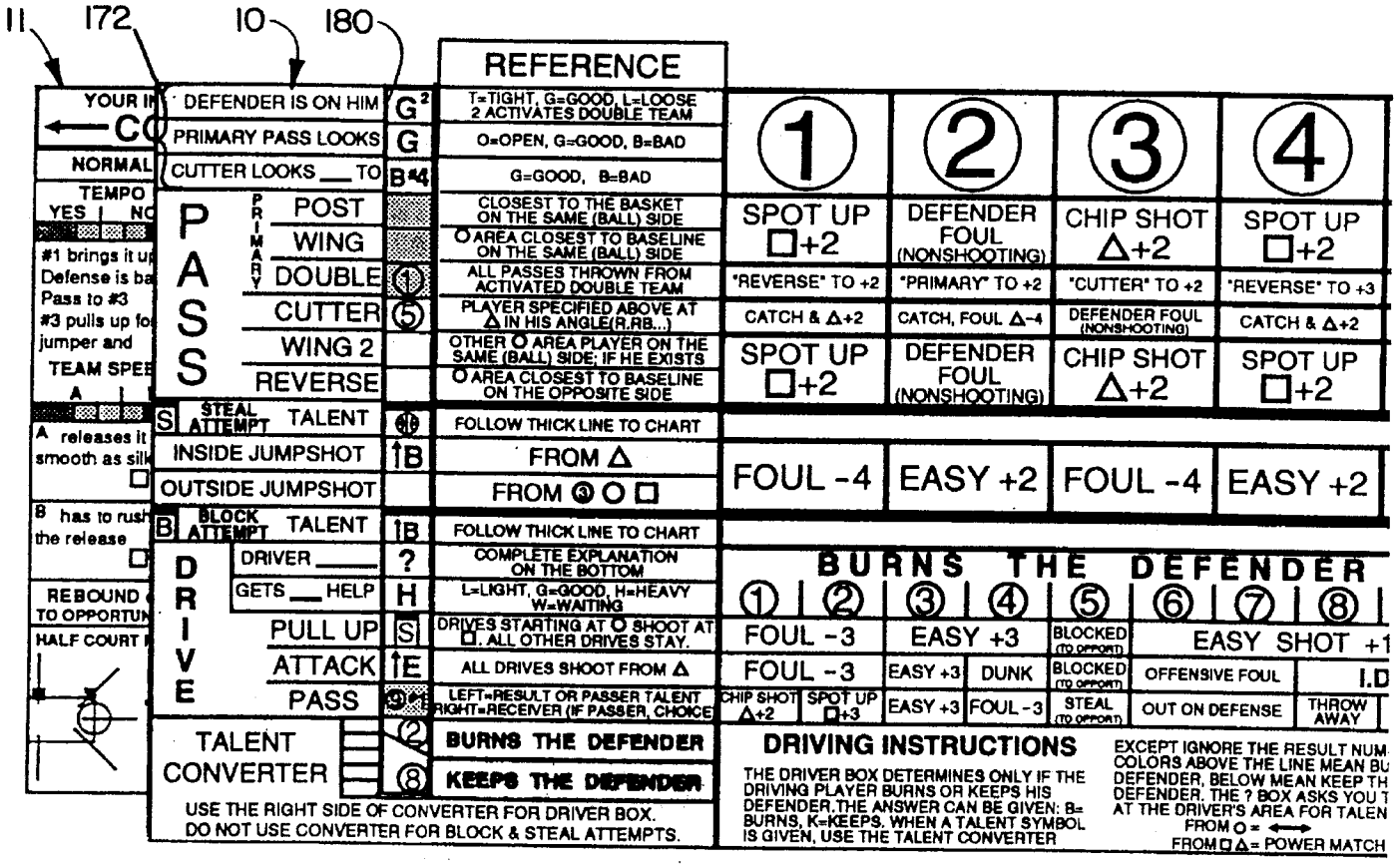
FIG. 10 illustrates a play card inserted in a play template for use in conjunction with a board game according to the present invention.

Using FIGS. 9 and 10, examples of a few rounds of play will be described.

A. EXAMPLE 1

Presuming that all setup has been completed (i.e. all players have been chosen and the coaching parameter panel has been appropriately marked), Team A has first possession. The coach for Team B reads the conditions in section 172, using the information from the first column of the possession side 190 of the play card", to complete the conditions: "Defender is on him good; primary pass looks good; cutter pass looks good to number 1." Given that information, the coach for Team A makes a decision to pass, shoot a jump shot, or drive. Let us say, for sake of an example, that the coach for Team A chooses to make a pass to the primary post player. The column visible from play card 11 through window 180 shows nothing. This means that the pass was completed to the primary post. Now, the coach for Team B slides the play card 11 to the left, such that the second column of the possession section 190 of play card 11 is visible in window 180. This is illustrated in FIG. 10. The coach for Team B again reads the conditions 172 to coach A: "The defender is on him good; the primary pass looks good; and the cutter pass looks bad to player number 4." Based on this information, the coach for Team A makes a decision to pass, shoot a jump shot, or drive. Let us say, again for the sake of example, that the coach for Team A chooses to make a cutter pass, in spite of the warning that that pass looks bad. The character given in window 180 on play card 11 next to cutter is a "5" with a circle around it. This indicates that the coach for Team B is to read the outcome in the row given by the cutter pass, and in the column under the large "5" with the circle around it in the pass outcome section 185 of the play template 10. This is not visible in FIG. 10, however, it is visible in FIG. 7. The caption in the row labeled "CUTTER" underneath the "5" outcome is "CATCH & –4". This means that the pass was caught and that the person who caught the pass attempts to make a shot from a triangle (Δ) area. Further, four is to be subtracted from the appropriate number in the player's shot matrix to determine whether or not the shot is made. This is a "modified shot". That is, the coach for Team A will look at the shot matrix for the player who caught the cutter pass, and will observe the numeral on the shot matrix in the triangle (Δ) row, in the hotness column given by the marker. (In this example, the game has just begun, and therefore the marker will be in the centermost column 73.) Thus, if the matrix illustrated in FIG. 4 were the matrix for the person who caught the cutter pass, the coach for Team A would observe the numeral indicated by $n_{1,3}$ and would subtract four from that number. The coach for Team A would then shake the 12-sided die, and would compare the base numeral determined by the die with $n_{1,3}$ minus four. If the base number is less than or equal to $n_{1,3}$ –4, then the basket was made. If the base number is not less than $n_{1,3}$ –4, then the ball must be rebounded.

To determine who comes up with the rebound, the coach for Team B will look to the transition portion 191 of play card 11. This is visible in FIG. 8. Specifically, the coach for Team B will look at the "HALF-COURT REBOUND" section 196 of the play card 11. Play card 11 indicates that the contest for the rebound is between the right posts. This particular play card further specifies "DEFENSE" which means that Team B comes up with the rebound.

Following a half-court rebound, the "NORMAL" transition portion 194 is used to determine the outcome of the transition. Generally, the transition portion 194 reads from the top down, providing announcer play-by-play about the transition play, and with a couple of tests to be performed to determine what happens on the transition. Beginning at the top, section 194 begins by noting that "TEMPO" is the first factor that will dictate whether or not Team B will have a transition play or whether Team B will re-set (i.e. begin its half-court offense). This is determined by observing the color that the coach has chosen for tempo. If the color the coach for Team B has chosen for tempo lies under the word "YES" in section 194 on play card 11, then, Team B has a normal transition play. The coach for Team B is still reading card 11, and reads the narrative immediately below the YES/NO colors. In this case, coach B would read: "Number 1 brings it up, defense is back, passes to number 3; number 3 pulls up for a jumper and . . ." To determine what happens next, "TEAM SPEED" is observed. The coach for Team B observes the color on the coaching parameter panel 9 for his team speed. If that color lies under "A" on the play card, then the narrative associated with letter A in section 194 of card 11 applies. Let us say, for example, that the team speed for Team B is given by a color that lies under the letter A. Then, the coach for Team B reads the narrative associated with letter A: "Releases it smooth as silk." Thus, player number 3 is attempting a shot. The shot is taken from the square (□) area, as given by the text associated with letter A. Further, the shot will be made if the die number (i.e. base number) rolled by the coach for Team B is less than or equal to the numeral on the player figure matrix in the square (□) row, in the marked or designated column with a three added thereto. Thus, if the shot matrix for player number three were that illustrated in FIG. 4, the die roll would have to be less than or equal to $n_{2,3}$ +(presuming that column 73 is the designated hotness column) in order for the player to make the shot. If player number three for Team B makes the shot, then the whole process begins again, with the coach for Team B drawing a second play card, inserting it into the template, and reading conditions 172, as filled in by the information given in the first three rows of the first column of the new play card.

B. EXAMPLE 2

Another example is offered to show how the outcome of a steal attempt is determined. Turning again to FIG. 9, assume that play has just begun. The coach for Team B has inserted card 11 into play template 10 and reads the conditions given in section 172, in cooperation with the information provided in the first three rows of the column of play card 11 visible in window 180. The coach for Team A chooses to have the player with the ball drive. Then, the coach for Team B will read the drive conditions given on the first two lines of the drive section 177: "The driver beats the defender; gets heavy help." Thereupon, the coach for Team A decides whether the driver should pull up, attack, or pass. Should the coach for Team A choose to attack, the coach for Team B reads that there is a steal attempt (symbolized by an "S" with a bar above it) by Team B. More specifically, the steal attempt will be made by the player FIG. 7 on Team B that has been aligned with the player FIG. 6 for Team A that has the ball. The coach for Team B will then go to the steal attempt line 174 on the play template 10 to determine the outcome of the steal. A basketball symbol is given in window 180 next to the steal attempt line. This means that the color of the basketball symbol on the player FIG. 6 that has possession of the ball must be observed. Let us say, that the player FIG. 6 having the ball for Team A, has an orange basketball on his player FIG. 6 (Recall that with reference to FIG. 2, this basketball is illustrated at the bottom of the player figure in area 42.) To determine whether or not the steal attempt is successful, the coach for Team B looks to the steal attempt chart 187 on the play template 10. This is not visible in FIG. 9, but can be seen on FIG. 7. Orange is the second color from the right on the steal attempt chart. The chart indicates that if a die roll of one or two is thrown, then the steal attempt is successful. If the die roll is three to ten, inclusive, then the defender fouls the Team A player with the ball. If the die roll is eleven, an offensive foul is committed, and if a die roll of twelve is thrown, the ball goes out of bounds on the offense. Let us say, for the sake of example, that a die roll of two is thrown, such that the steal is successful. Now the ball is in the possession of a player on Team B and a transition situation occurs. An opportunity transition results from a steal.

Thus, the "OPPORTUNITY" transition section 195 on play card 1, is consulted to determine what happens next. The play card indicates that the first parameter to be observed is team speed. If the color of team speed on the coaching parameter panel 9 is a color lying under "YES" in section 195 of the play card 11, then the narrative is read: "Number 2 brings it up; it's a breakaway." The next parameter to be considered is the vertical leaping ability (indicated by a capital E with an arrow to the left thereof) of player number two. Thus, the area 43 of the player figure for player number two is observed. The color of that symbol in area 43 is compared with the colors under the A and B in section 195 of play card 11. If that color lies under the A, then the A narrative is read: "He dunks one for the highlight film." The play is over, and Team A gets possession of the ball, with coach B drawing a new play card and inserting it into the play template.

C. Example C

The next example illustrates the use of the talent converter 178 on the play template 10. Again, assuming that play has just begun, the coach for Team B inserts a play card 11 into play template 10, as shown in FIG. 9, and reads conditions 172 incorporating the information from the play card 11. Let us say that the coach for Team A makes a decision to make a cutter pass. Next to the word "CUTTER" in the window 180 is an eye symbol. This eye symbol represents court sense. To determine whether or not the cutter pass is completed, the coaches look to the area 44 on the player FIG. 6 having possession of the ball. Area 44 is illustrated in FIG. 2. Referring again to FIG. 9, the color of that symbol is observed. Let us say that that color is yellow. The coach for Team B then goes to the talent converter 178 on the play template 10. The window 180 immediately adjacent to the talent converter, shows a line extending from one side of the window to the other side. This line is slanted for the particular play card illustrated. That line intersects the talent converter 178 at a line that lies between the red and orange colors on the talent converter. This means that if the color of the symbol with which we are concerned lies above the line, then the outcome will be given by the column headed by the large "4" with a circle around it. If the color of the talent symbol of interest lies below the line in window 180, then the outcome will be that given in the column headed by the large "7" with the circle around it. Thus, for the play card illustrated in FIG. 9, if the color of the eye symbol on the player figure is red, the outcome under the large "4" with the circle around it applies; if the color of the eye symbol of interest is orange, yellow, green, or blue, then the outcome given in the column headed by the large "7" with a circle around it applies.

It would be impractical to describe every possible chain of events that can occur during play of a game 1 according to this invention. Therefore, a flow chart 1000, FIGS. 11–28, sets out substantially all possible occurrences, decisions, and results in the preferred embodiment illustrated.

VI. Miscellaneous Game Features

A. Game Time

One preferred way of determining when the game ends is by keeping track of the time of the game. Preferably, this does not involve keeping track of the time that the board-game 1 is being played, but rather simulating the time for playing the basketball game. One manner of doing this is to have each play card represent a certain period of time. For example, the players (i.e., coaches) can agree to end the game after all playing cards have been used a predetermined multiple of times (i.e., the stack of 45 cards has been shuffled and used eight times).

B. Substitutions

The game according to the present invention provides for the limited substitution of players during the game. The "adjustments" section of the coaching parameter panel keeps track of the number of substitutions that a coach makes between time outs. Players' playing time is limited by the number of time units described on their shots matrices.

VII. Flow Chart

A flow chart 1000 for a preferred embodiment of the present invention is provided in FIGS. 11–28. Due to requirements regarding the size of lettering, the flow chart is split into several figures, with indications provided as to how the flow chart continues from figure to figure. This flow chart 1000 describes one embodiment of a game according to the present invention. Considerable variation, particularly with symbols, can be within the spirit of the invention. Additionally, the game can be simplified considerably and be within the spirit of this invention.

Throughout the discussion of the flow chart 1000, reference numerals greater than 1000 refer to steps on the flow chart and therefore do not necessarily label the preceding noun, as is typically the function of reference numerals.

Figure 11:
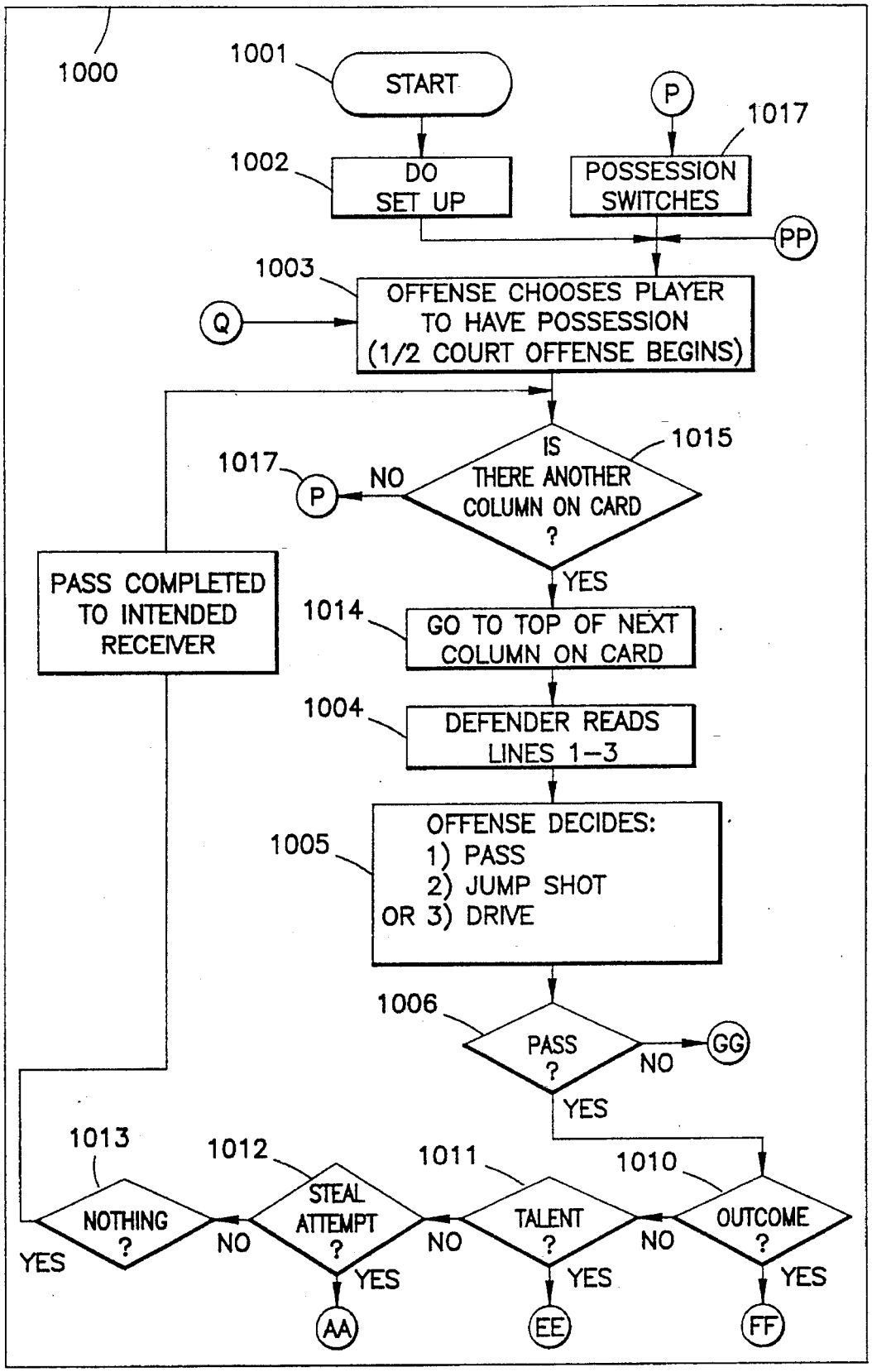
Figure 12:
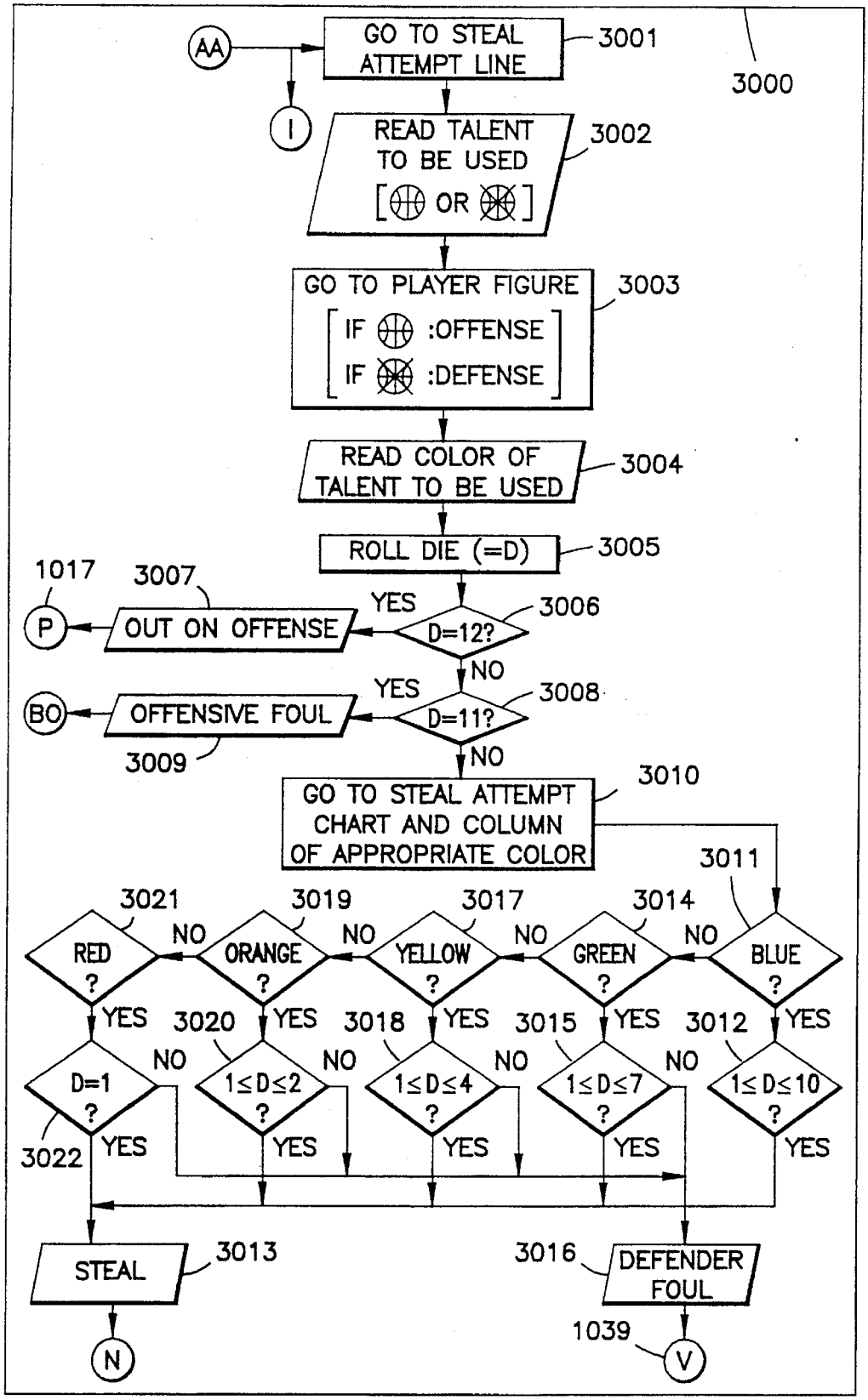
Figure 12A:
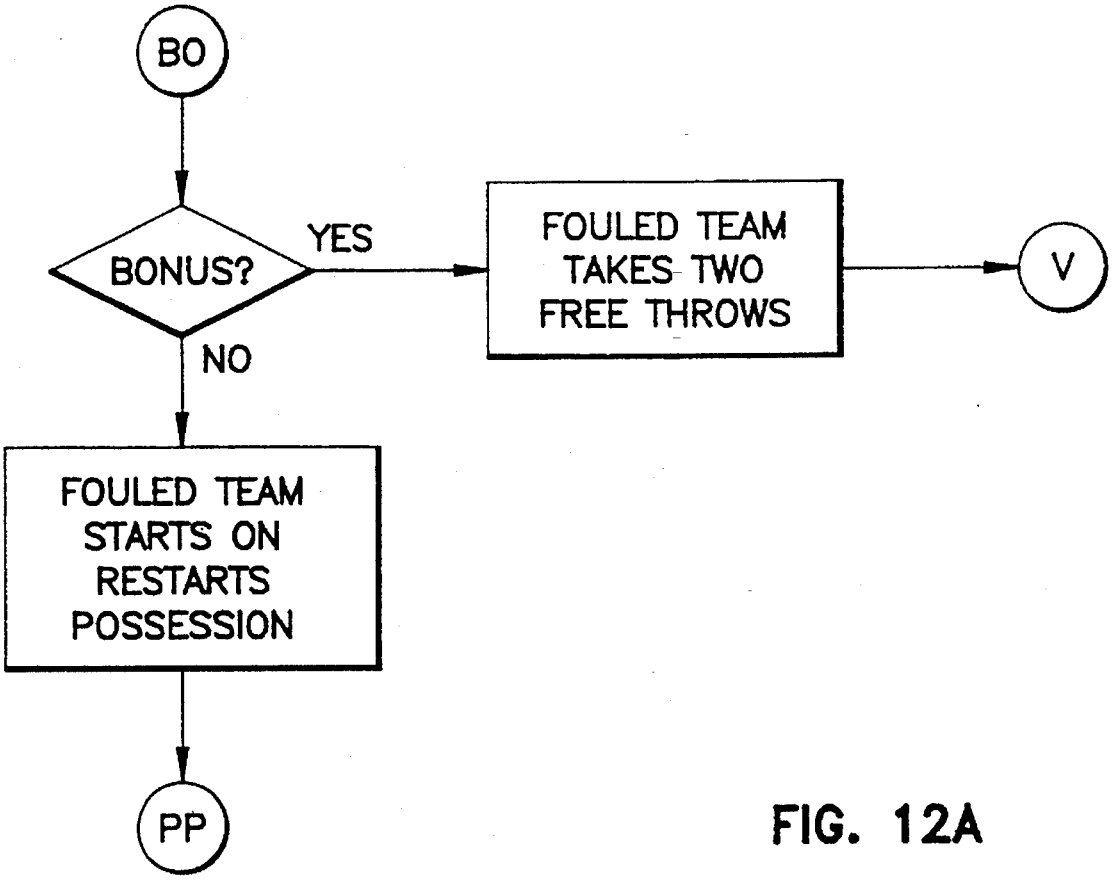
Figure 13:
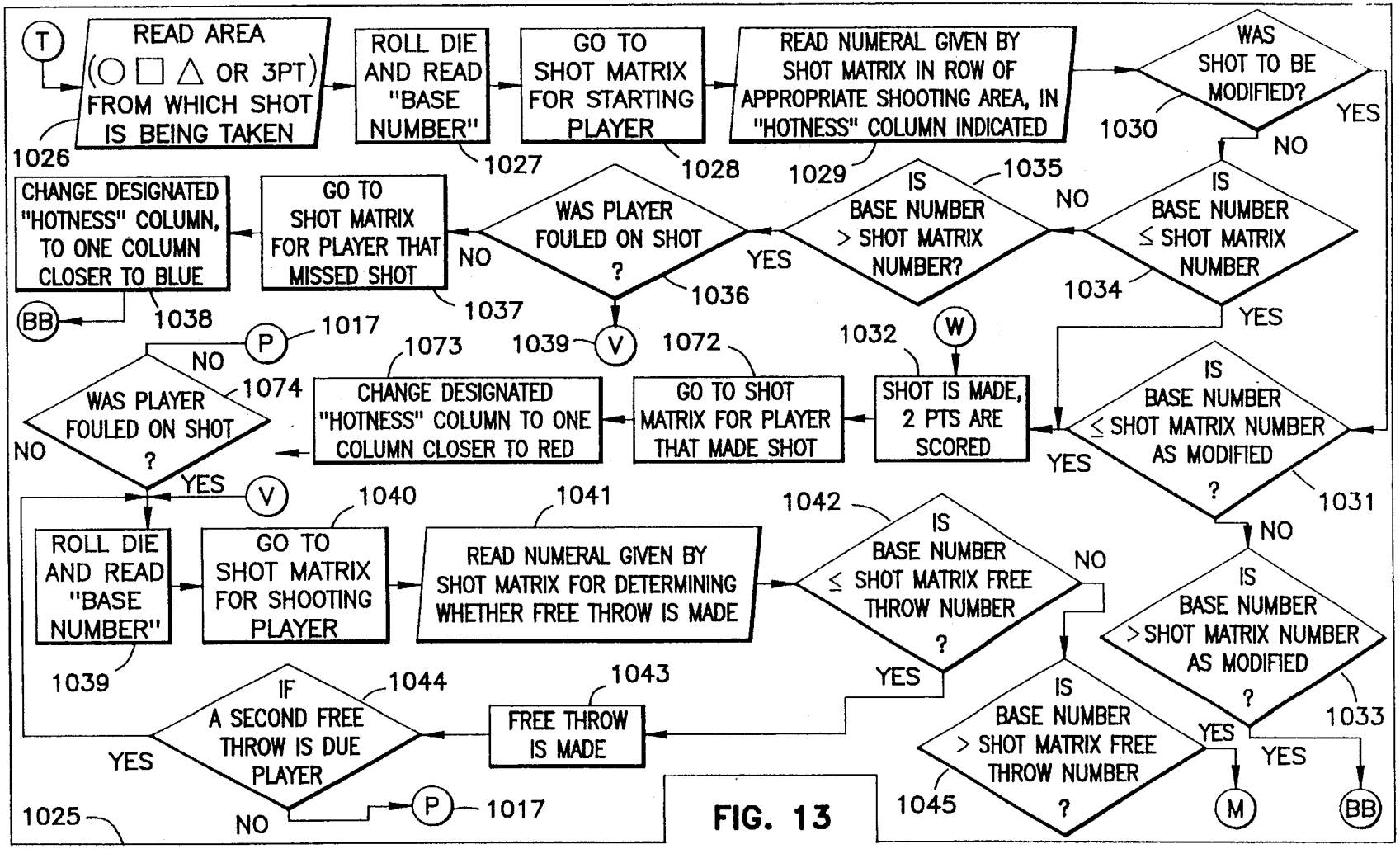
Figure 14:
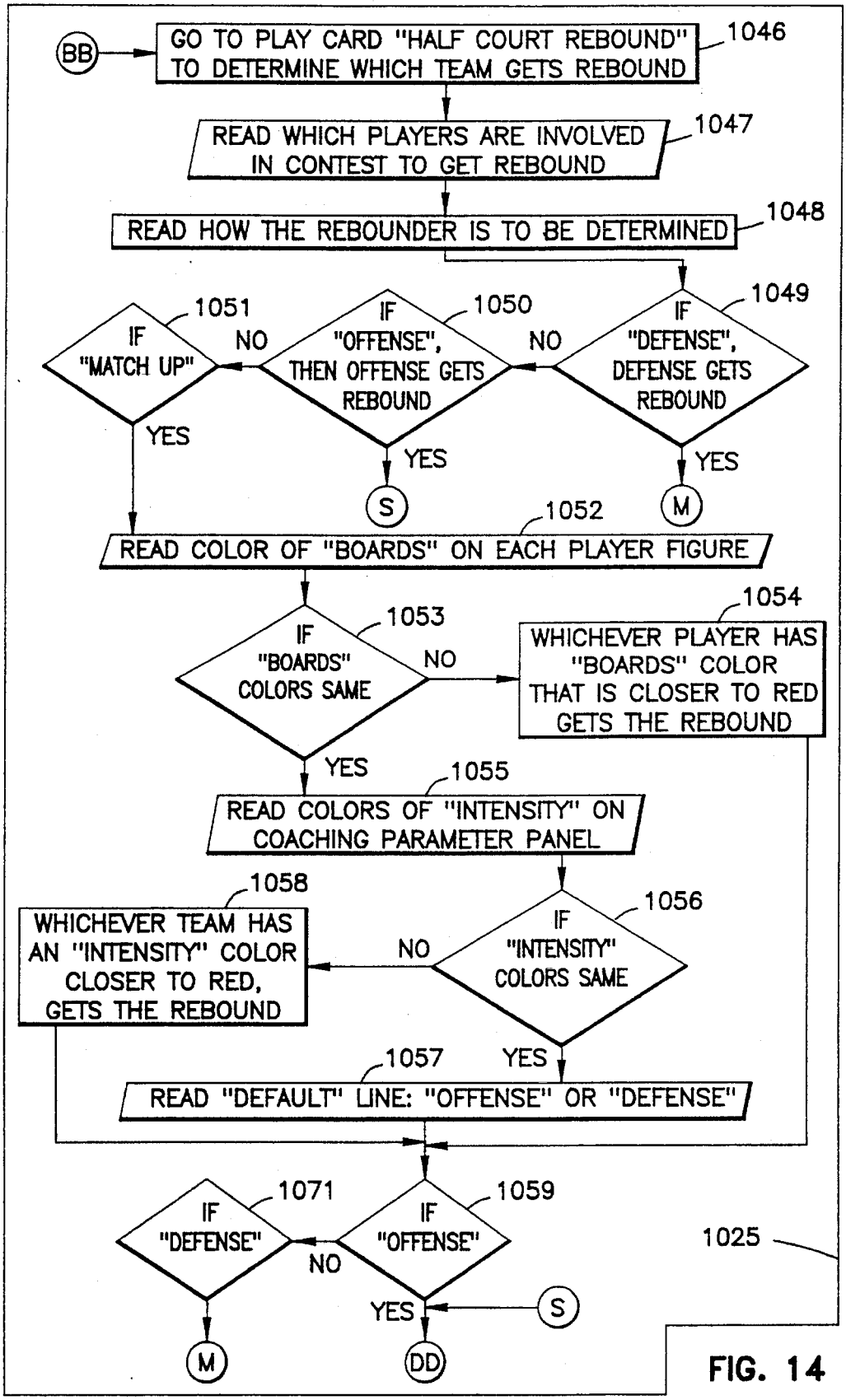
Figure 15:
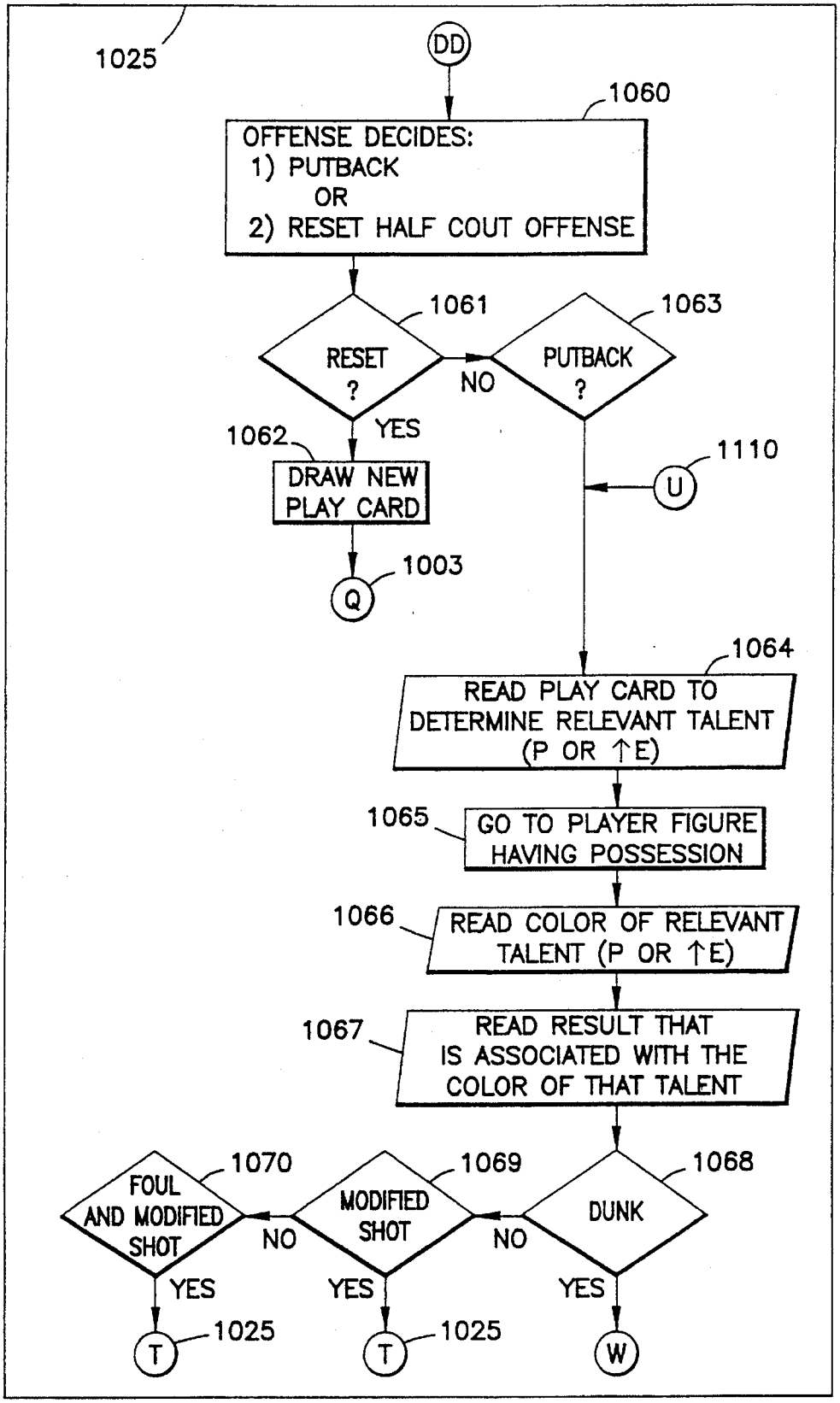
Figure 16:
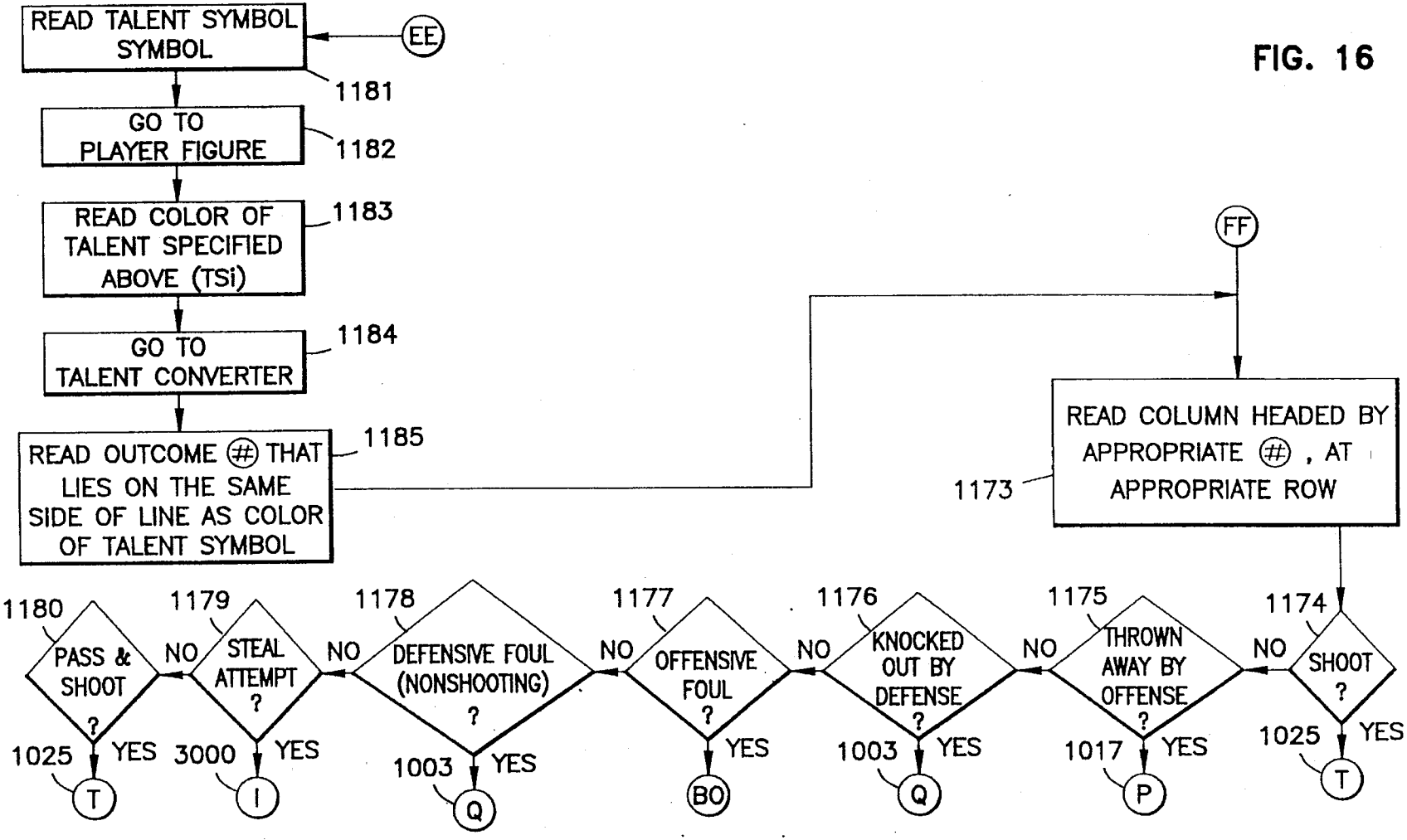
Figure 17:
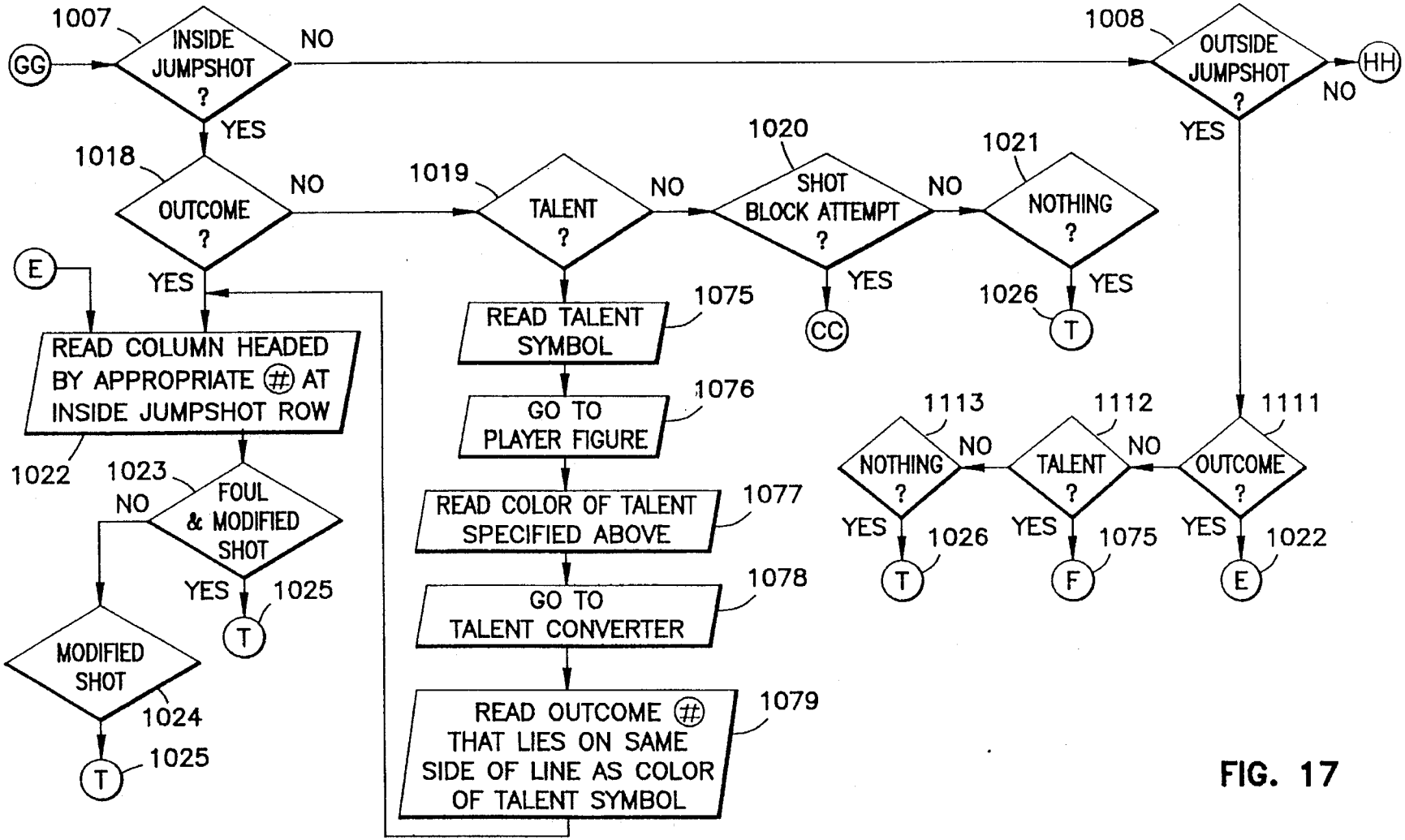
Figure 18:
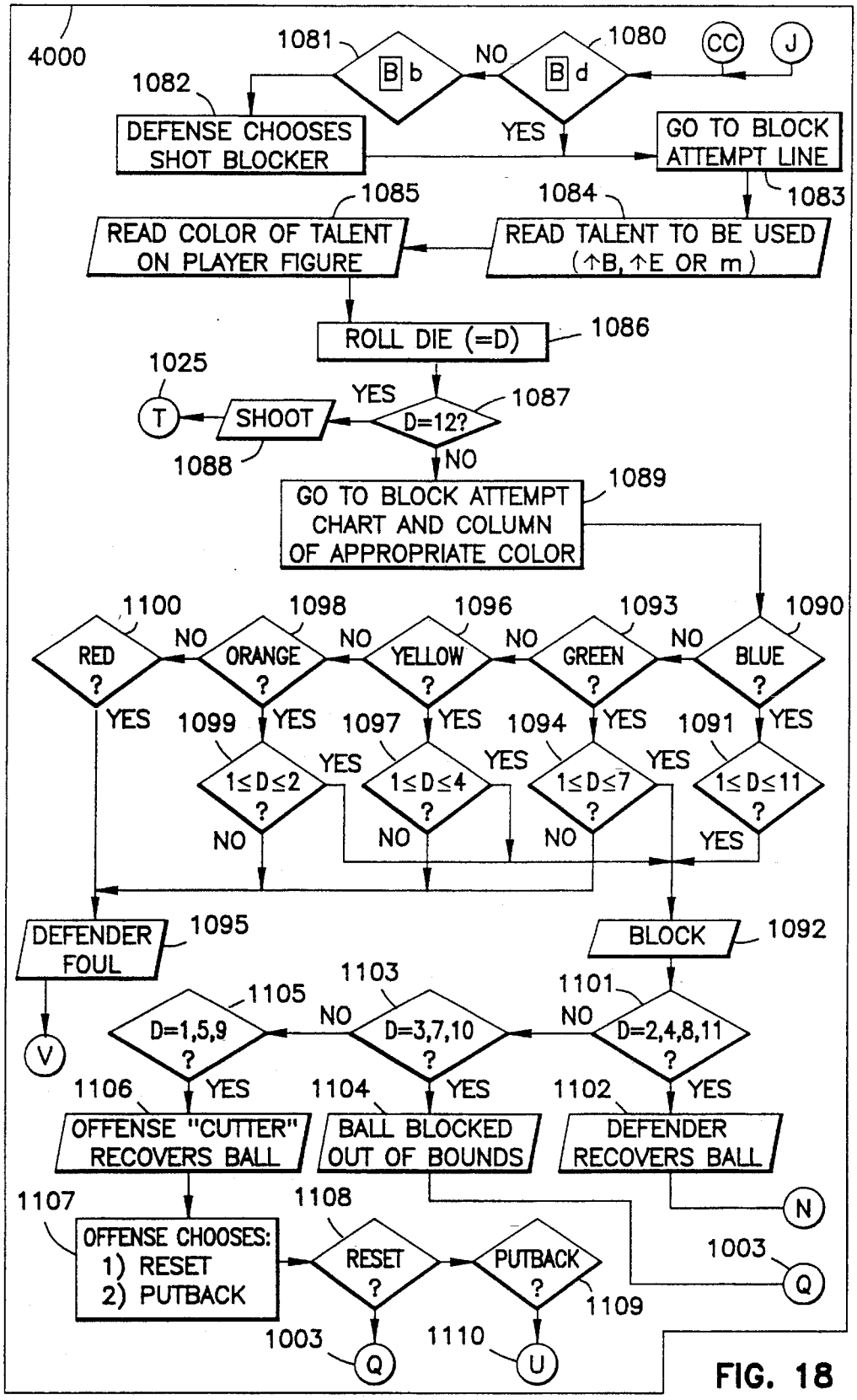
Figure 20:
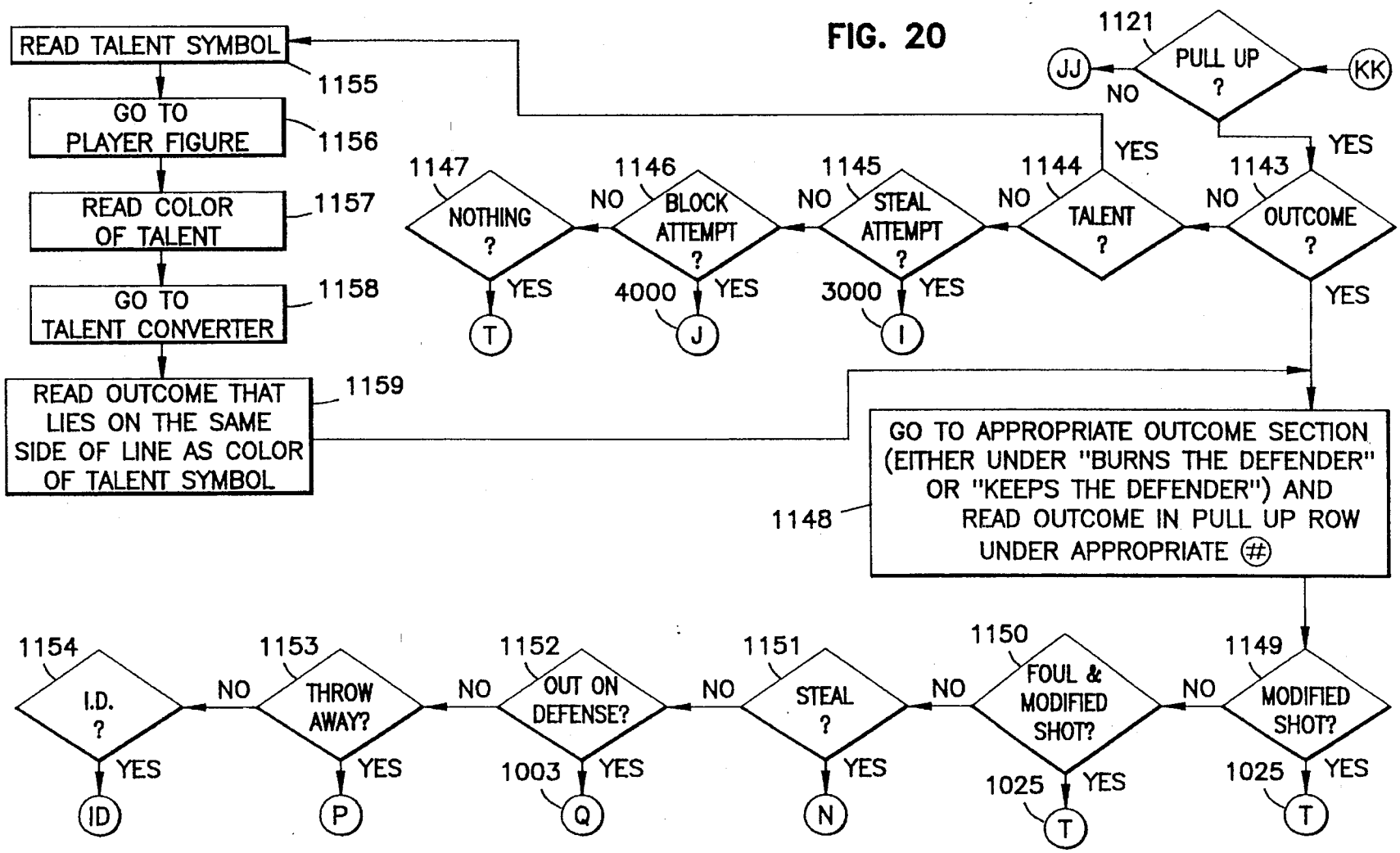
Figure 20A:
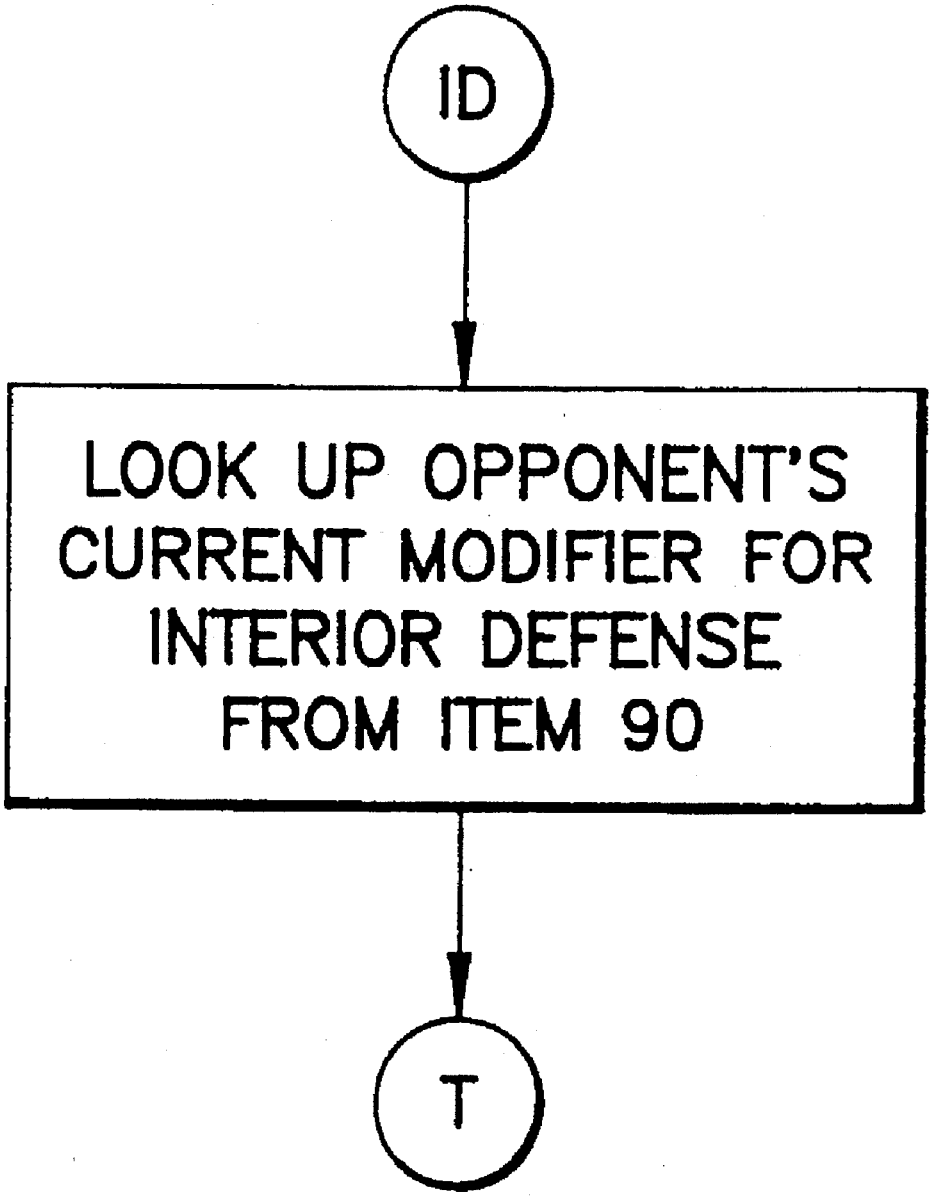
Figure 21:
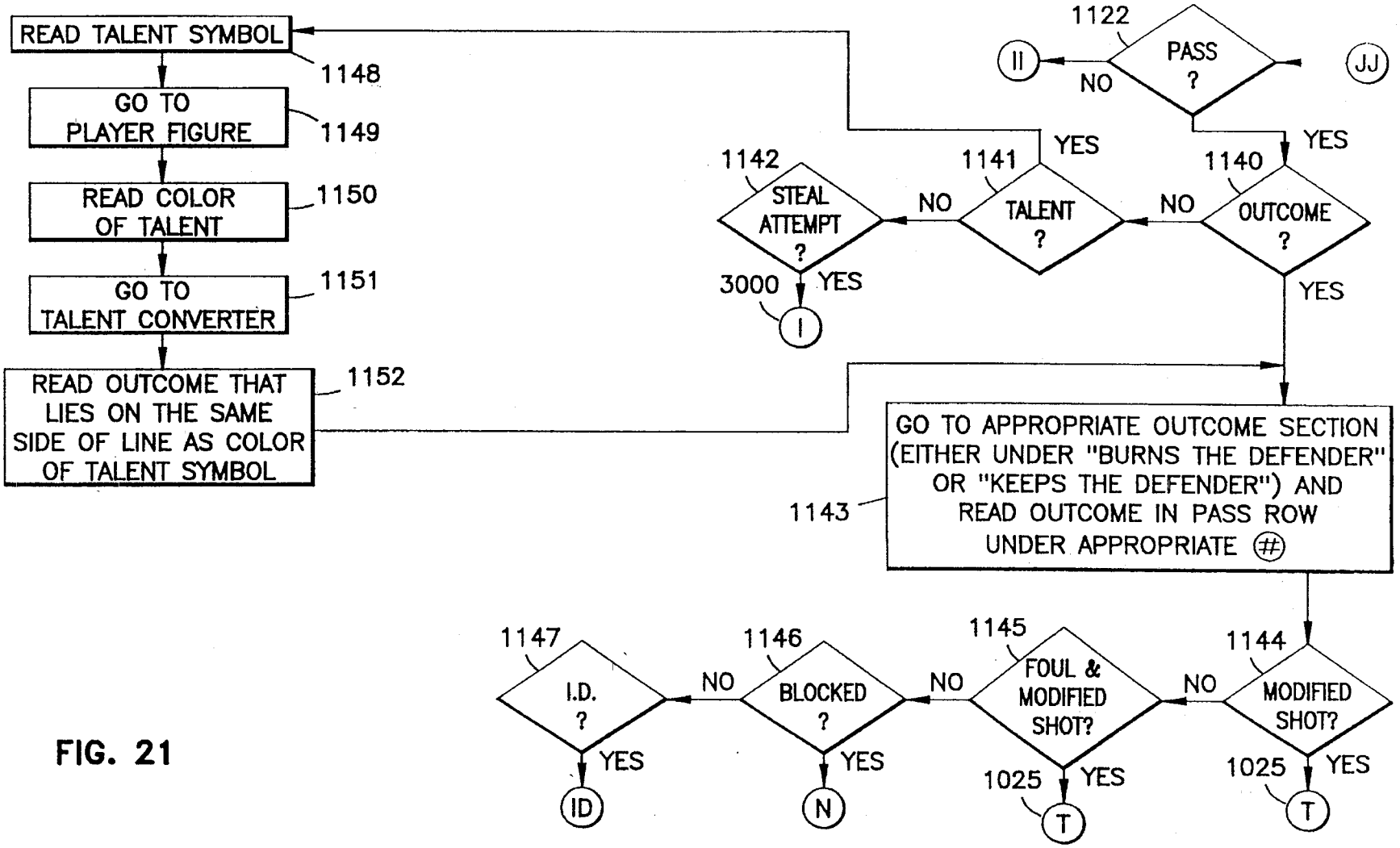
Figure 22:
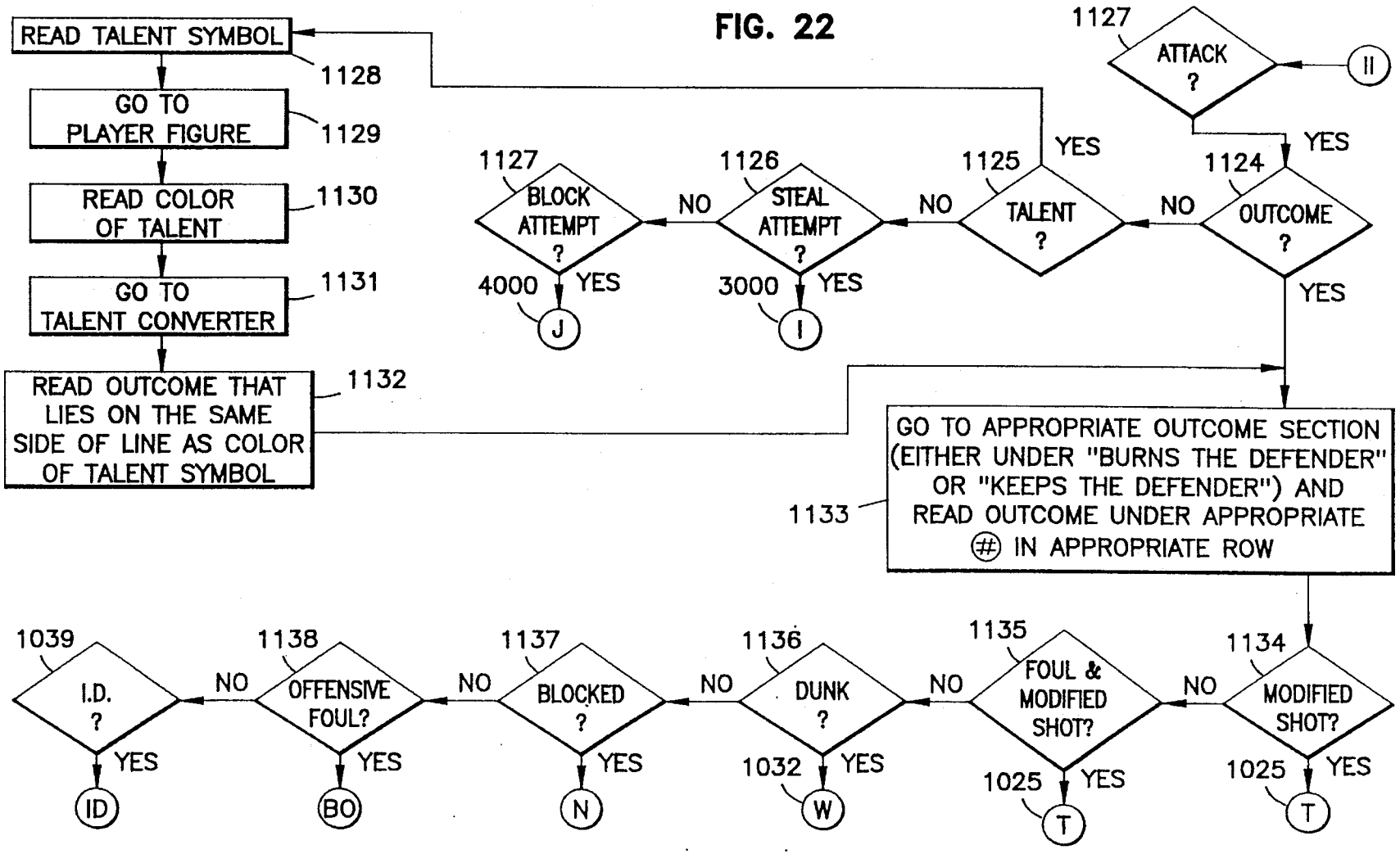
Figure 23:
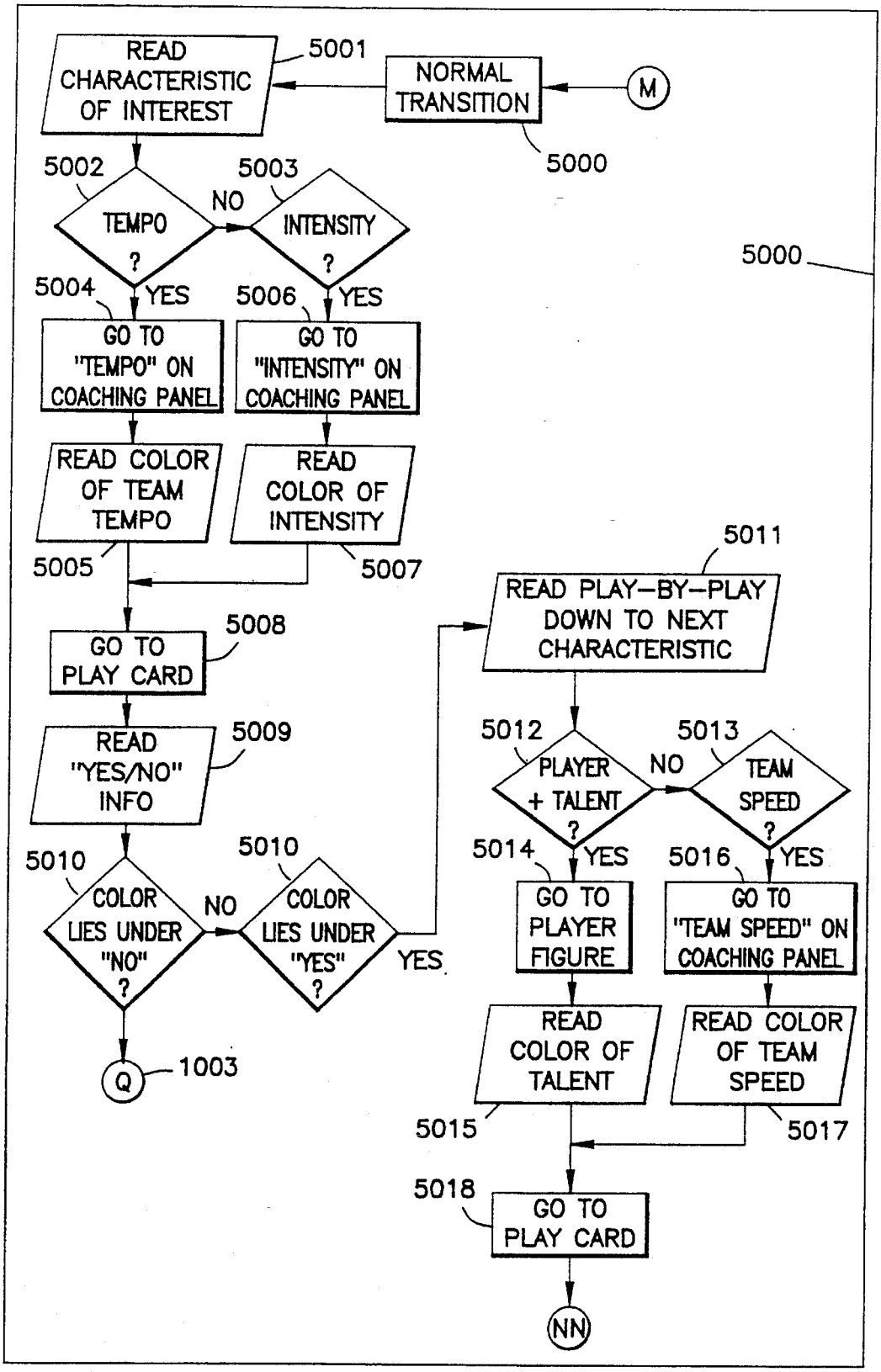
Figure 24:
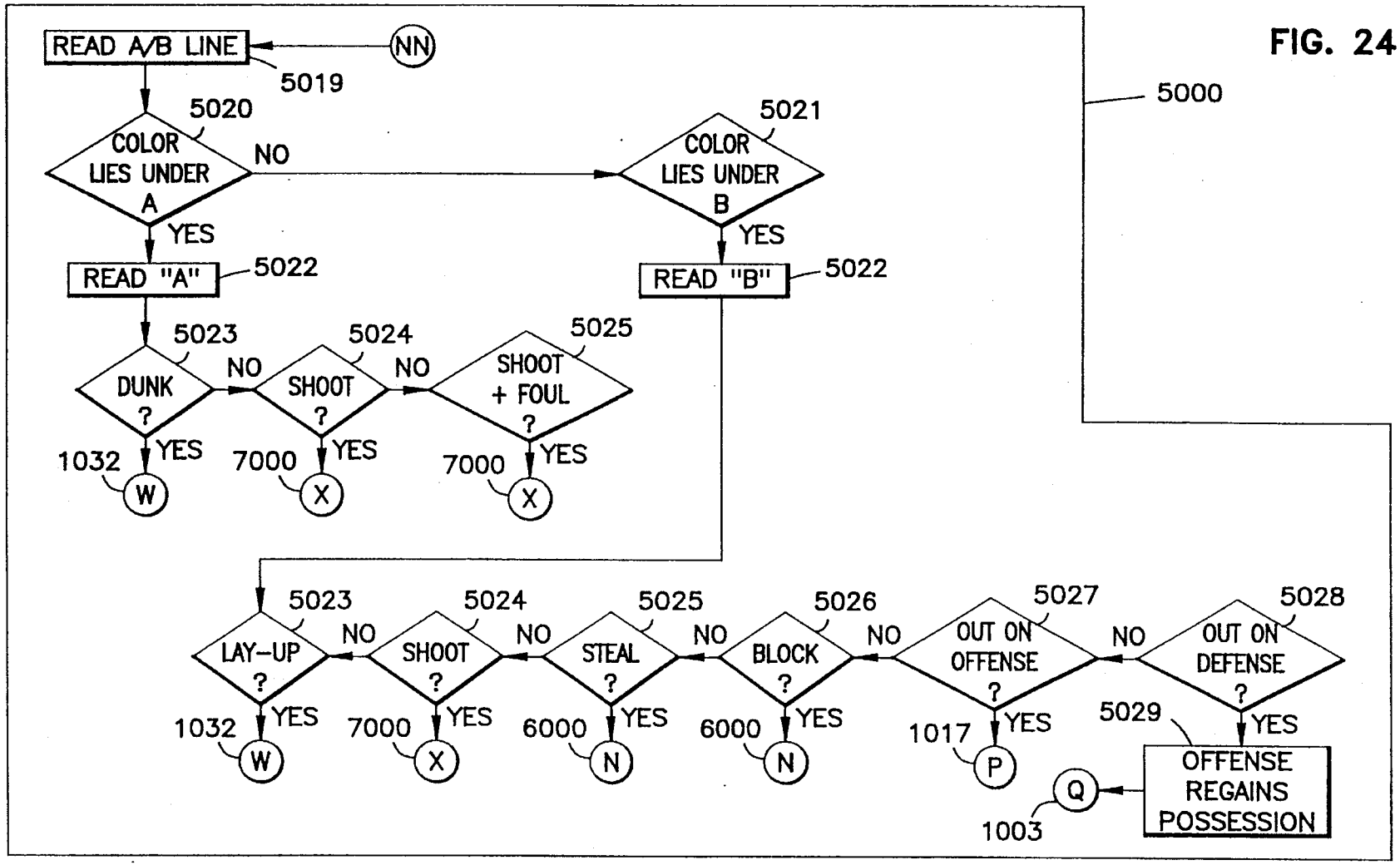
Figure 25:
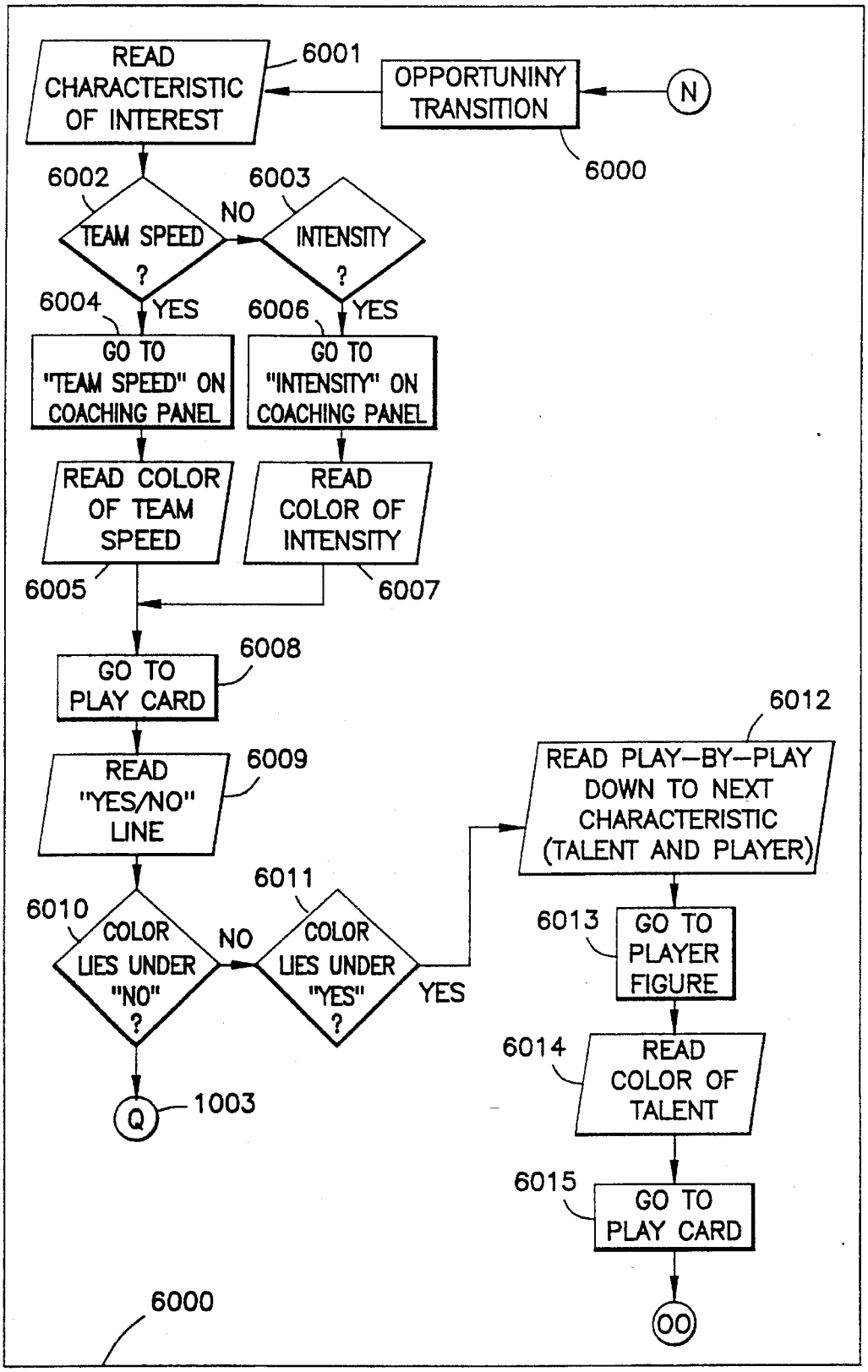
Figure 26:
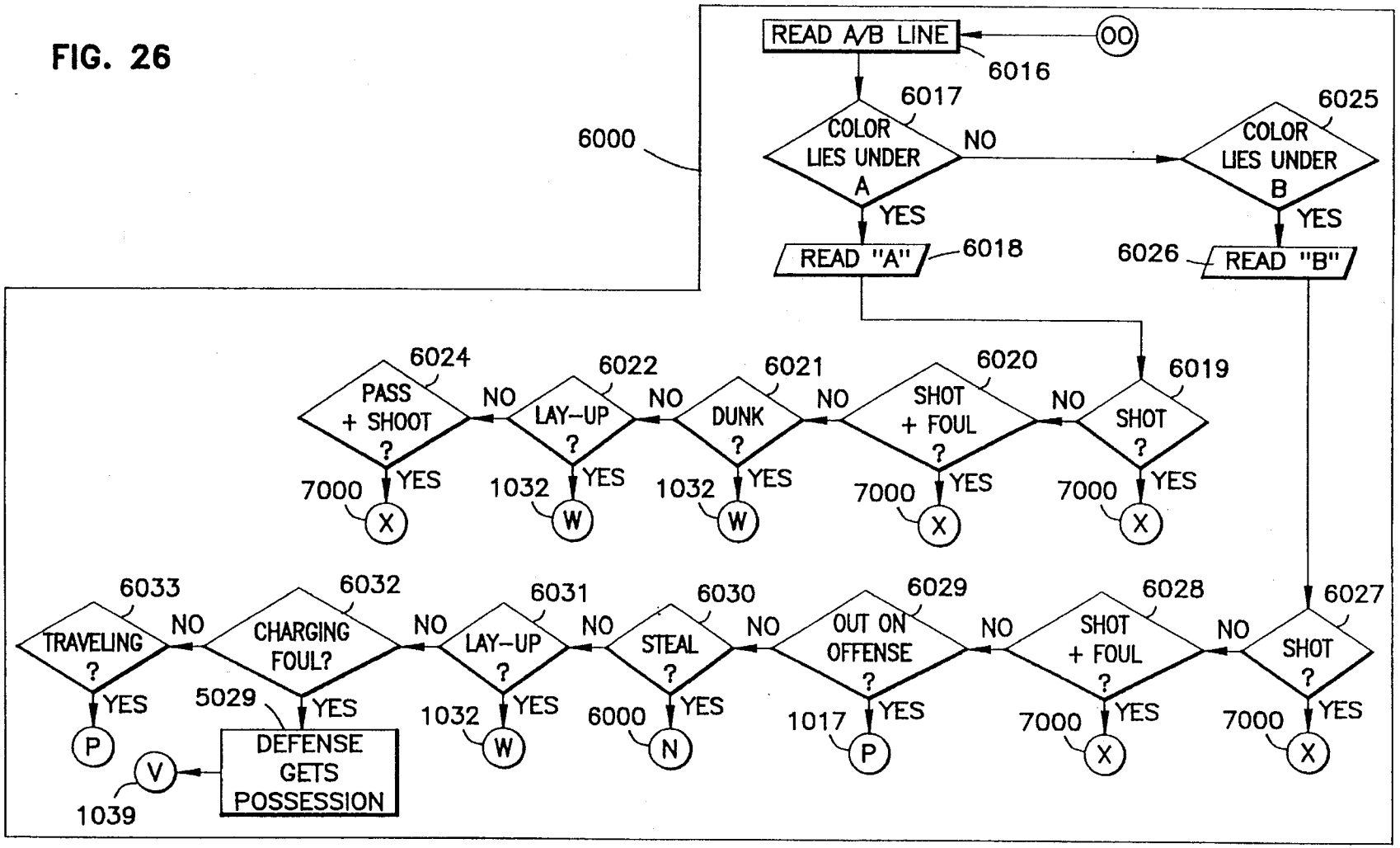
Figure 27:
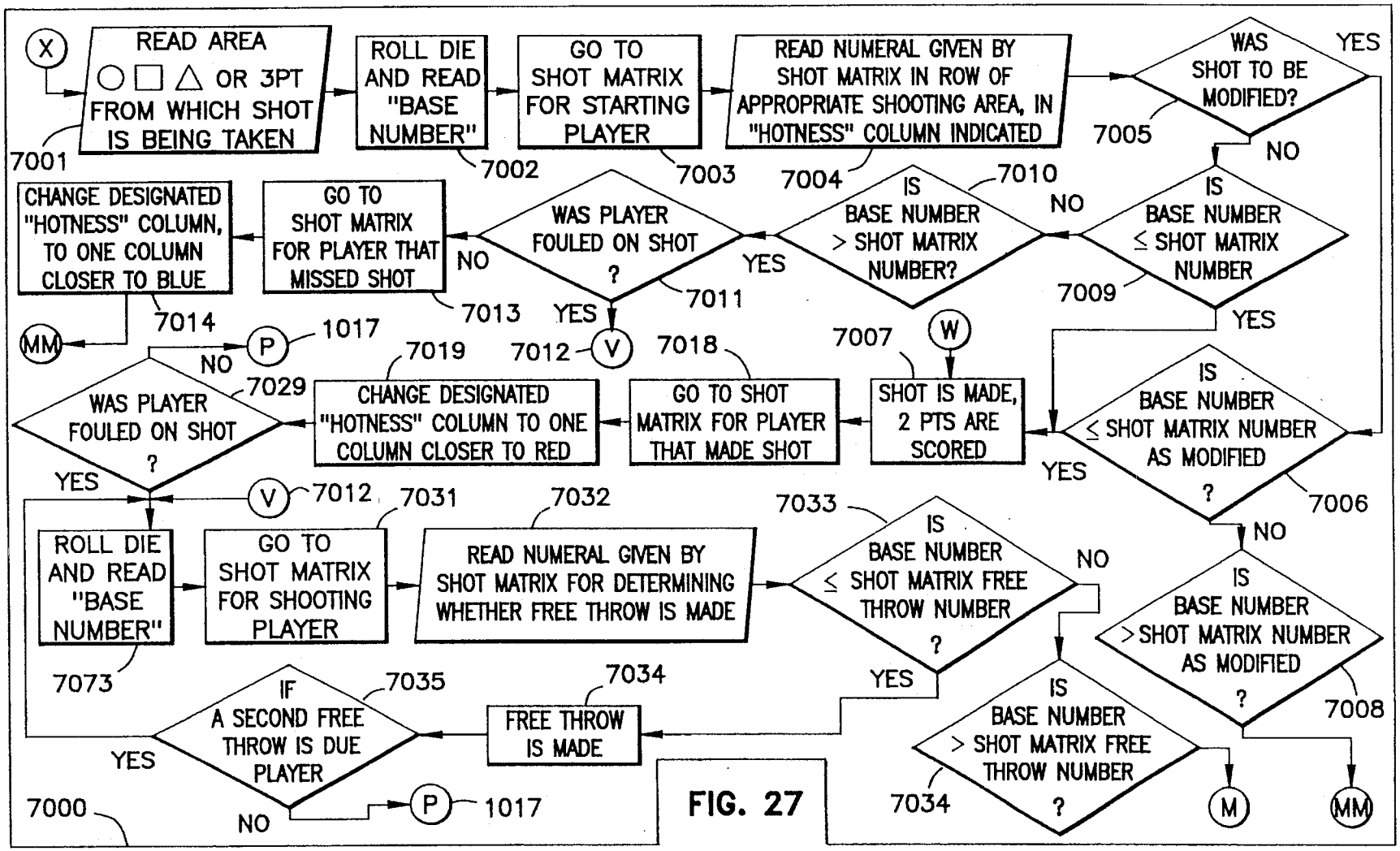
Figure 28:
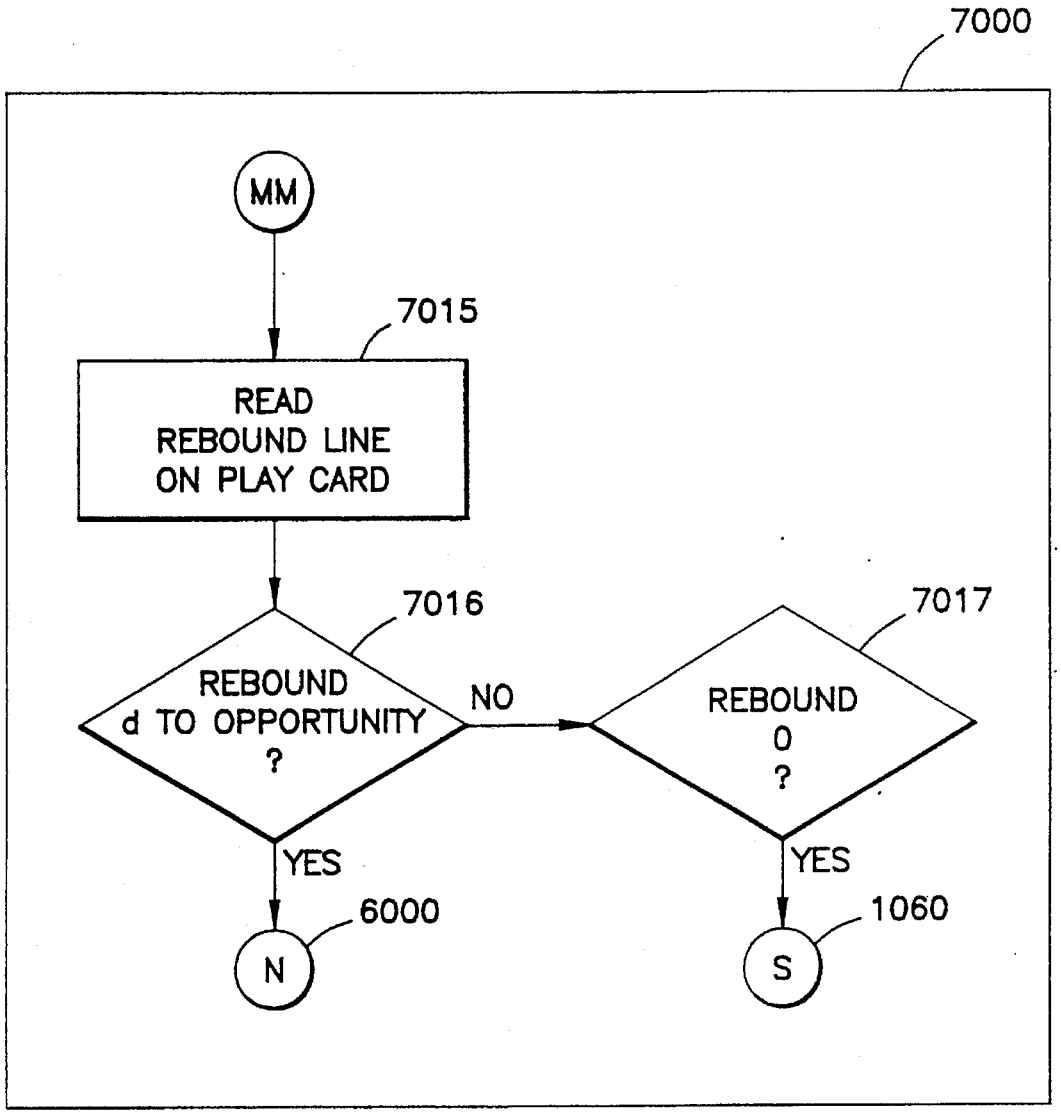

Beginning with FIG. 11, the start of the game is represented. At 1001 the players begin by doing setup 1002, as described above. The setup includes selecting player figures and selecting coaching parameters. Next, the offense chooses which player is to have possession 1003. This the beginning of the half-court offense. Thereafter the coach for the defending team reads the condition lines 172 on play template 10 in conjunction with the first column visible through window 180 from play card 11.

Thereafter, the offense decides 1005 whether to pass 1006, shoot a jumpshot (inside 1007 or outside 1008 depending on a player's position) or drive 1009. The coach makes his or her decision based on the information he or she has from the conditions 172 and with the information provided on the player FIGS. 6, 7 and shot matrices **8*a*–8*c*** regarding the players' skill levels.

Beginning first with the pass 1006 option, any one of the following four things can occur on the play card 11 next to the pass option lines: an outcome symbol (a number with a circle around it) 1010; a talent symbol 1011 which could be any one of the following: a basketball symbol, an eye symbol, or a lateral two-headed arrow; a steal attempt symbol which is an "S" in a box with a bar above the "S"; or nothing 1013. If there is nothing 1013 in the appropriate box next to the pass choice, the defensive coach then goes to the top of the next column on the same play card 1014 and begins the process again at 1004 with the ball now passed to a new player. If the defending coach finds that there are no further columns on the card (i.e. the ball has been passed successfully four times, for example) 1015, then possession switches 1017.

Had the offense decided 1005 to shoot an inside jumpshot 1007, then the following four possibilities may be illustrated in the appropriate row on play card 11, as seen through window 180: an outcome symbol 118; a talent symbol 1019 which may be either a capital letter B with a vertical arrow to the left of the B, or a small "m" with the circle, square, and triangle symbols to the right of the "m"; a shot block attempt symbol, which is a capital letter B in a box with the bar above the B and a small "b" or small "d" to the right of the box, 1020; or nothing 1021. Beginning first with the outcome 1018 path, the defending coach will read the outcome column headed by the appropriate number and on the inside jumpshot row 1022. That outcome will either be a foul and modified shot 1023 or just a modified shot 1024. In either case, a shooting "subroutine" defines what happens next.

The shooting subroutine 1025 begins by reading the area (Δ, □, ○ or three point) from which the shot is being taken 1026. In most cases, this will be the location (Δ, □, ○) on the game board 5 on which the player having possession of the ball is located. In other cases, certain text on the play cards or play template will dictate from where the shot is being taken.

Next, the offensive coach activates the means of chance to determine a base number 1027. The offensive coach then looks to the shot matrix for the shooting player 1028. The coach reads the numeral given by the shot matrix that is located in the row of the appropriate shooting area and in the hotness column that is designated 1029. If the shot was to be modified 1030 then the shot matrix number is modified by the modifier number (i.e. adding or subtracting some number thereto or therefrom) and comparing that modified number with the base number 1031. If the base number is less than or equal to the shot matrix number as modified, then the shot is made 1032 and two points are scored. If, however, the base number is greater than the shot matrix number as modified 1033, then the shot is missed, and a rebound situation results.

If, however, the shot matrix number did not need to be modified at 1034, and if the base number is less than or equal to the shot matrix number, then the shot is made 1032. If the base number is greater than the shot matrix number, then the shot was missed. It is necessary to next consider whether or not the player is fouled on a shot 1036. If not, the coach for the shooting player goes to the shot matrix for that player 1037 and changes the designated hotness column to one column cooler or closer to blue 1038. If the shooting player was fouled on the shot, then a free throw opportunity results. The coach for the player shooting the free throw will roll a die and read the base number 1039. Then that coach will go to the shot matrix for the shooting player 1040 and read the numeral given by the shot matrix for determining whether a free throw is made 1041. If the base number is less than or equal to the shot matrix free throw number 1042, then the free throw is made 1043 and if a second free throw is owed to the shooting player 1044 then the free throw process begins again at 1039. If a second free throw is not due the shooting player, then possession of the ball switches and the coaches return to 1017 on the flow chart. If the base number was greater than the shot matrix free throw number 1045 then the free throw is missed and a rebound situation results.

Returning to the path after box 1038, the coach reading the play card reads the half-court rebound section to determine which team gets the rebound 1046. Specifically, the coach reads the card to determine which players are involved in the contest to get the rebound 1047. The play card indicates what factors are to be used to determine which of the two players gets the ball 1048. If the card reads "DEFENSE", then the defensive player gets the rebound 1049. If the card reads "OFFENSE", then the offensive player gets the rebound 1050. If the card reads "MATCH-UP" 1051, then the coach reads the color of the "BOARDS" talent located on each of the player figures 1052. That is, the colors of the word "BOARDS" on both the offensive and defensive player figures involved in the contest for the rebound are compared 1053. If the "BOARDS" colors are not the same, then whichever player has the "BOARDS" color that is closer to red gets the rebound 1054. If, however, the "BOARDS" colors are the same, then a second factor is considered. The coaches read the colors of "INTENSITY" on the coaching parameter panel for each of the teams 1055. If the "INTENSITY" colors are the same 1056 then a default line on the card is read which reads either "OFFENSE" or "DEFENSE" 1057. If the "INTENSITY" colors are not the same, then whichever team has an "INTENSITY" color that is closer to red gets the rebound 1058. If it is the offense which gets the ball, as a result of having either the "BOARDS" color or the "INTENSITY" color be closer to red 1059, then the coach for the offense decides whether the player with the ball will try a putback (reshoot the ball) or whether the offense will reset 1060. If a reset is chosen 1061, then the defensive coach will draw a new play card 1062 and the process begins again at box 1003. If the offensive coach decides instead to try a putback 1063, then the defensive coach reads the play card to determine which talent is relevant in determining whether or not the putback will be successful 1064. Either a P or a capital E with a vertical upwardly-pointing arrow will be pictured. The coaches then consider the player figure which has the ball 1065 and reads the color of the relevant talent (P or capital letter E) 1066. Additionally, the play card indicates the result that is associated with the color of that talent 1067. If the result indicates a dunk 1068, then the shot is made and play continues from box 1032. The other two possible results of the putback are a modified shot 1069 or a foul plus a modified shot 1070. In either case, play resumes at box 1026.

Returning to box 1057, if the card indicates that the defense gets the ball 1071, then a transition situation results. The transition "subroutines" will be described below.

Whenever a shot is made 1032, the coach for the shooting player will go to the shot matrix for that player 1072 and will change the designated hotness column to one column closer to red 1073. If the player was not fouled on the shot 1074, then play resumes at 1017 with a change of possession. If, however, the player was fouled on the shot, a free throw is shot beginning with box 1039.

That completes the shooting subroutine 1025.

Returning to the outcomes 1018 through 1021 that can result when the offense decides at box 1005 to shoot an inside jump shot 1007, we will now consider what will happen if the result given by the play card 11 is a talent symbol. In the preferred embodiment illustrated, the talent symbol will be either a capital B with a vertical arrow to the left of the B, or a small "m" with a circle, square and triangle next to the "m". The coach reading the play card 11 will read the talent symbol of interest as given by the play card 1075. Next, the player figure is consulted 1076, and the color of the relevant talent symbol on the player figure is determined 1077. Next, the talent converter is consulted 1078, and an outcome that lies on the same side of the line as the color of the relevant talent symbol is determined 1079. Then, the coaches read the column headed by the appropriate number at the inside jump shot row 1022 and play continues from there as described above.

If a shot block attempt 1020 is the result given by the play card 11 when an inside jump shot is chosen 1007, one of two symbols will be showing on card 11. Either a capital letter B with a bar above it and small "d" next to the B 1080, or a capital letter B with a bar above it with a small "b" instead of a small "d" is shown 1081. If the capital B/small "b" is shown, then the defensive coach may choose a player to make the block attempt 1082. If the capital B with the small "d" 1080 is shown then the defender who is assigned to defend the player with possession of the ball will attempt to block the shot. Next, the coach reading the play card and template (at this point it is still the defensive coach) goes to the block attempt line on the play template 1083 and reads the talent that is to be used in determining the result of the block attempt 1084. This symbol will either be a capital letter B, a capital letter E, or a small "m". The coach reads the color of that talent on the player figures involved in the shot block attempt 1085. Thereafter, the offensive coach roles the die 1086 and reads the "base number" on the die. If that number equals twelve 1087, then the shot is not blocked and a shot is taken 1088. Play then continues in the shooting subroutine 1025. If the die roll is not equal to twelve, then the block attempt chart is consulted 1089 to determine if the shot is blocked or if the player is fooled depending upon the die roll and the color of the player's talent. If the color of the relevant talent has determined at box 1085 is blue 1090 and the die roll is between one and eleven, inclusive, 1091, then the shot is blocked 1092. If the relevant talent was green 1093, and the die roll is between one and seven, inclusive, 1094, then the shot is blocked. If, however, the talent is green 1093 and the die roll is between eight and eleven, inclusive, then the defender commits a foul 1095. If the relevant talent color is yellow 1096 and the die roll is between one and four, inclusive, then the shot is blocked 1092. If, however, the relevant talent is yellow 1096 and the die roll is between five and eleven, inclusive, 1097, then there is a defender foul. If the relevant talent color is orange 1098 and the die roll is one or two 1099, then the shot is blocked 1092. If, however, the relevant talent color is orange 1098, and the die roll is three to eleven, inclusive, then there is a defender foul. If the relevant talent color is red, then there is a defender foul 1095.

If the shot was blocked 1092 and the die roll is equal to two, four, eight, or eleven 1101, then the defense recovers the ball 1102. If the shot is blocked 1092 and the die roll is equal to three, seven, or ten 1103, then the ball is blocked out of bounds 1104. If the shot is blocked 1092 and the die roll is equal to one, five, or nine 1105, then the offensive cutter recovers the ball 1106. At that point, the offense chooses whether to try a putback or to reset the half-court offense 1107. If the offense chooses to reset 1108, play resumes at box 1003. If, however, the offense chooses a putback 1109, then play continues at 1110, within the shooting subroutine 1025. If the ball was blocked out of bounds, then play resumes at box 1003. If the defense recovered the ball 1102, then a transition results, which will be described below.

If there is no symbol 1021 on the inside jump shot row, after the offense has decided to pursue an inside jumpshot 1007 and play continues from box 1026 to determine if a shot is made.

If at box 1005 the offense decided to attempt an outside jumpshot, then there are three possible results that may appear on playing card 11: an outcome 1111, a talent 1112 (which will be either a lateral two-headed arrow, or a small "m"), or nothing 1113. If an outcome number is given at 1111, then play resumes at box 1022, discussed above. If a talent symbol is shown 1112, then play continues at box 1075 as discussed above. If nothing is shown, then play continues from box 1026, as discussed above.

If the offensive coach at box 1005 decides to drive 1009, the defensive coach reading the play template and play cards will read the symbol in the window on the "Driver " line 1114. There are four possibilities for symbols that will appear on the play card 11 next to the "Driver " line. These are a "B" 1115 (for "Burns the Defender"); a "K" 1116 (for "Keeps the Defender"); a question mark ("?") 1117 (which means that whether the driver burns or keeps the defender is yet to be determined); or a talent symbol 1118 (a two-headed lateral arrow or a small "m").

If the symbol is either a "B" or a "K" 1115 or 1116, then the defensive coach reads the "Gets help" line 1119. At this point, the offense decides whether to pull up, attack, or pass 1120. These options are given at decision points 1121, 1122, and 1123. If the offense decides to attack 1123, then there are four possible symbols on the play card next to the attack line. These are an outcome 1124, a talent symbol 1125 (which will be a capital letter E); a steal attempt symbol 1126, or a block attempt symbol 1127. If there is a shot block attempt 1127, then play resumes at block 1080, in the block attempt subroutine 4000. If a steal is attempted 1126, then a steal attempt subroutine 3000, which will be discussed below, is followed. If a talent symbol is given 1125, then that talent symbol is read. The coaches go to the player figure 1129 and read the color of that talent 1130. They then go to the talent converter 1131 and read the outcome that lies on the same side of the line as the color of that talent symbol 1132. Thereafter, the coach reading the play template will go to the appropriate outcome section (either under "Burns the Defender" or "Keeps the Defender") and reads the outcome under the appropriate number in the appropriate row 1133. Those outcomes will be one of the following: a modified shot 1134; a foul plus a modified shot 1135; a dunk 1136; a blocked shot 1137; an offensive foul 1138; or an indication that the interior defense is to be observed 1139. If there is either a modified shot 1134 or a foul plus a modified shot, then subroutine 1025 is used for determining whether the shot is made. If a dunk 1136 is made, then play resumes at box 1032 within the shooting subroutine 1025. If the outcome is a dunk 1136, then play continues at box 1032 within subroutine 1025. If the outcome is that the shot is blocked 1137, then a transition situation occurs as will be discussed below. If an offensive foul 1138 occurs, then one of two things happens. If the offensive team has five fouls (as indicated by a marker on the "team fouls" section of the coaching panel), then the player fouled shoots two free throws. If, however, the offensive team has less than five fouls, then possession switches, and play continues 1017. If "I.D." is given in the outcome 1039, then a shot is taken, modified by the numeral marked in the I.D. section 1147 of the coaching panel.

If, at box 1120, the offense decides to pass 1122, then any one of the three following results may be found on the play card next to the word "PASS" on the play template: an outcome 1140, a talent symbol 1141 (either a basketball for ball-handling ability or an eye indicating court sense), or a steal attempt 1142. If an outcome 1140 is given, then the reader goes to the appropriate outcome section (either under "Burns the Defender" or "Keeps the Defender") as determined at 1115 and 1116 above and reads the outcome in the "PASS" row under the appropriate outcome number 1143. Any one of the following outcomes may be given: a modified shot 1144, a foul plus a modified shot 1145, a blocked shot 1146, or "I.D." 1147. If a modified shot 1144 or a foul plus a modified shot 1145 are given, then play flows to the shooting subroutine 1025. If the shot is blocked, a transition situation, as will be described below, results. If "I.D." is given in the outcome 1039, then a shot is taken, modified by the numeral marked in the I.D. section 1147 of the coaching panel. If a talent symbol is provided at 1141, the card reader will read the appropriate talent symbol 1148, and will then go to the player figure 1149 and read the color of that talent symbol on the player figure 1150. Next, the talent converter is consulted 1151, and the outcome number that lies on the same side of the line as that color in the talent converter is determined 1152. Play continues at box 1143.

If a steal attempt results from the pass 1122, then play continues at subroutine 3000, which will be discussed below, to determine the result of the steal attempt.

If, at decision box 1120, the offense decides to pull up 1121, then the following five results may be indicated in window 180 by the play card 11: an outcome 1143; a talent symbol 1144 (which would be a small "m" with a square, triangle and circle next to it); a steal attempt 1145; a block attempt 1146; or nothing 1147. If an outcome is indicated 1143, then the reader goes to the appropriate outcome section (either under "Burns the Defender" or "Keeps the Defender") and reads the outcome in the pullup row under the appropriate outcome number 1148. The possible outcomes are a modified shot 1149, a foul plus a modified shot 1150, a steal 1151, out on defense 1152, a throw away 1153, or interior defense 1154. If the outcome given is a modified shot or a foul plus a modified shot 1149 or 1150, then play continues with subroutine 1025 for determining whether or not the shot is made. If a steal is the outcome 1151, then a transition subroutine is employed.

If the ball goes out on the defense 1152, then play resumes at box 1003, with the offense resetting for its half-court offense. If the ball is thrown away 1153, play resumes at box 1017. If interior defense "I.D." is noted under the outcome 1154, then a shot is taken, modified by the numeral given in the I.D. section on the coaching panel.

If the talent symbol is given at 1144 for the pullup choice 1121, then the card reader reads the talent symbol located in the window 1155, and then goes to the player figure 1156 and reads the color of that talent on the player figure 1157. Next, the talent converter 1158 is consulted, and the outcome number that lies on the same side of the line of the color of the talent symbol is read 1159. Thereafter, the appropriate outcome section is read and play continues from box 1148. If a steal is attempted 1145 after the pullup 1121, then subroutine 3000 is employed to determine the result of the steal attempt. If there is a block attempt 1146 after the pullup 1121, then play continues at the block attempt subroutine 4000. If there is nothing 1147 next to the pullup 1121 choice, then subroutine 1025 is used for determining whether the shot is made.

Returning to block 1114, if there is a question mark 1117 for filling in the "Driver " line, the position of the player with the ball on the court is considered. If that player is located on a circle 1160, the coaches go to the player figure 1161 and read the color of the talent symbol of the two-headed lateral arrow 1162. The coaches then consult the talent converter 1163 and determine 1164 whether the symbol color lies above the line that extends across the window 180. If the color of the symbol lies above that line, the player with the ball has burned the defender 1165, and play resumes at 1115. If, however, the symbol color lies below the line in the window 1166, then the holder of the ball keeps the defender 1167 and play resumes at box 1116.

Returning to box 1117, if the player having the ball is located at a square or triangle 1168, the coaches observe the player figure 1169, and read the color of the P symbol 1170 for power. The coaches then continue play from box 1163.

If there is a talent symbol 1118 that fills in the line "Driver " at 1114, then the coaches go to the player figure 1171 and read the color of that talent symbol 1172. Play then continues from box 1163.

Now returning to the pass option 1006 as decided by the offense at box 1005, as noted above, any one of four results can appear in window 180 of play card 11: outcome 1010, talent 1011, steal attempt 1012 or nothing 1013. If an outcome is given 1010, then the player reading the card, reads the column headed by the appropriate number, at the appropriate row 1173. Any one of the following outcomes is possible: shoot 1174; the ball is thrown away by the offense 1175; the ball is knocked out by the defense 1176; an offensive foul 1177; non-shooting defensive foul 1178; a steal attempt 1179; or a pass and a shot 1180. With either a shot 1174 or a pass and shoot 1180, play continues with the shot subroutine 1025. If there is a non-shooting defensive foul 1178 (and the defensive team has not reached the bonus), or the ball is knocked out by the defense 1176, play resumes at box 1003. If the defense committed more than four fouls in the quarter, the offensive team is awarded two bonus free throws.

If there is a steal attempt 1179, the steal attempt subroutine 3000 described below is followed. If the ball is thrown away by the offense 1175, then the ball changes possession and play resumes at box 1017. If there is an offensive foul, and the offensive team has five team fouls, then the player fouled shoots two free throws. If, however, the offensive team had less than five team fouls, then possession switches 1017.

If a talent symbol 1011 is given next to the pass 1006, then the coach reading the play card and template reads the talent symbol 1181, and goes to the player figure of the player holding the ball 1182. The coaches read the color of the specified talent 1183 and then go to the talent converter 1184 and read the outcome that lies on the same side of the line as the color of the talent symbol 1185. Thereafter, play continues with box 1173.

If there is a steal attempt 1012 after pass 1006, then the steal-attempt subroutine 3000 is followed. According to the steal-attempt subroutine, the coaches go to the steal attempt line 3001, and the reader reads the talent to be used 3002. This will be either a basketball or a basketball with an X through it to indicate ball handling or ball stealing ability, respectively. The coaches then go to the player FIG. 3003. If a basketball symbol was indicated in 3002, then the offensive player figure is considered; if the basketball with an X through it is given in 3002, then the defensive player figure is observed in 3003. The color of the talent is read 3004, and the coach rolls the die 3005. If the die roll equals twelve 3006, the ball is out on the offense 3007 and play resumes at box 1017 with a switch of possession. If, the die roll equals eleven 3008, there is an offensive foul 3009. If the offensive team has five team fouls, then the player fouled shoots two free throws. If the offensive team has less than five team fouls, then possession switches 1017.

If the die roll is not equal to either eleven or twelve, then the steal attempt chart is used to determine the result of the steal 3010. If the talent color is blue 3011, and the die roll is between one and ten inclusive 3012, then the steal is successful 3013.

If the talent color is green 3014 and the die roll is between one and seven inclusive 3015, then the steal attempt is successful 3013. If, however, the talent color is green 3014, and the die roll is between eight and ten inclusive, then there is a defender foul 3016. If the talent color is yellow 3017, and the die roll is between one and four inclusive, then the steal attempt is successful 3013. If, however, the talent color is yellow 3017, and the die roll is between five and ten inclusive, then there is a defender foul 3016. If the talent color is orange 3019, and the die roll is one or two 3020, then the steal attempt is successful 3013. If the talent color is orange 3019 and the die roll is three to ten, inclusive, then there is a defender foul. If the talent color is red 3021 and the die roll is equal to one 3022, then the steal attempt is successful. If, however, the talent color is red 3021 and the die roll is two to ten inclusive, then there is a defender foul on the play.

If there is a defender foul as a result of the steal attempt 3000, then play resumes at box 1039 to determine the result of free throws. If the steal attempt is successful there is an opportunity transition as will be described below.

There are essentially two types of transition plays that can occur during the play of this board game 1. First is a normal transition, which is illustrated in the flow chart 1000 as subroutine 5000. Normal transition 5000 occurs after a transition basket or a half-court rebound. To determine the result of a normal transition play, the card-reading coach reads the character of interest 5001 which is at the top of the play card 11 immediately under the title "NORMAL". The characteristic of interest will either be the tempo 5002 or the intensity 5003. If the characteristic of interest is the tempo 5002, then the coaches go to "TEMPO" on the coaching parameter panel 5004 and read the color of the tempo 5005. Alternatively, if the characteristic of interest is intensity 5003, then the coaches go to the "INTENSITY" on the coaching panel 5006 and read the color of intensity 5007.

Regardless of whether tempo or intensity is the characteristic of interest, the next step is to go to the play card 5008 to read the "YES/NO" information 5009. If the color of the characteristic of interest lies under the word "NO" 5010, then there is no transition play, and the game proceeds from box 1003, with the team that had been the defense prior to the rebound beginning with its half-court offense. If, however, the color of the characteristic of interest lies under the word "YES" 5011, then the card reader reads the play-by-play text down to the next identified characteristic 5011. That characteristic of interest will either be a player number plus a talent 5012 or team speed 5013. If the card indicates a player plus a talent 5012, the coaches look to the specified player FIG. 5014 and read the color of the talent of interest 5015. If, however, team speed is the characteristic of interest 5013, then the coaches go to the "TEAM SPEED" on the coaching parameter panel 5016 and read the color of the team speed 5017.

Regardless of which characteristic is of interest at 5012 and 5013, the coaches next go to the play card 5018 and read the "A/B" line 5019. They observe whether the color of the characteristic of interest lies under the "A" 5020 or the "B" 5021. If the characteristic of interest falls under paragraph A, the reading coach reads paragraph "A" 5022. Any one of the following three things will happen as defined in paragraph A: a dunk 5023, a shot 5024, or a shot plus a foul 5025. If there is a dunk 5023, the shot is made, and play continues at box 1032 within shooting subroutine 1025. If paragraph "A" calls for a shot or a shot plus a foul 5024 or 5025, a special subroutine 7000 for shooting is followed. This special shooting subroutine 7000 will be explained further below. If the color of the relevant characteristic lies under the letter "B" 5021, then the card reader will read paragraph B 5022 on the play card. Paragraph B may describe any one of the following results: a layup 5023, a shot attempt 5024, a steal 5025, a block 5026, out on the offense 5027, or out on the defense 5028. If the described result is a layup 5023, then the play flows to block 1032 within the shooting subroutine 1025. If the result is that a shot is to be taken 5024, then the subroutine 7000 is followed, as will be described below. If paragraph B describes a steal 5025 or a blocked shot 5026, then subroutine 6000 for an opportunity transition, described below, results. If the ball goes out on the offense 5027, then possession switches and play resumes at block 1017. If the ball goes out on the defense 5028, then the offense regains possession 5029, and play resumes at block 1003.

As noted above, the second type of transition is an opportunity transition. This is described in the flow chart 1000 by subroutine 6000. An opportunity transition results from a steal, a blocked shot, or a transition rebound. The opportunity transition is described on the play card under the column "OPPORTUNITY". The opportunity transition begins by the card reader reading the characteristic of interest 6001. That characteristic will either be team speed 6002 or intensity 6003. If the characteristic of interest is team speed 6002, then the card reader goes to the "TEAR SPEED" indicator on the coaching parameter board 6004 and reads the color of the team speed 6005. If, however, the characteristic of interest is the intensity 6003, then the coaches go to the "INTENSITY" marker on the coaching parameter panel 6006 and read the color of intensity 6007. Regardless of whether team speed or intensity was the characteristic of interest, at this point the card-reading coach goes to the play card 6008 and reads the "YES/NO" line. If the color of the characteristic of interest lies under "NO" 6010, play goes to block 1003 and flows from there. If, however, the characteristic of interest has a color that lies under the word "YES" 6011, then the card reader reads the play-by-play under the word "YES" 6012 down to the next characteristic which will be a talent plus a player number. Then, the coaches go to the player figure 6013 to read the color of that talent 6014. Thereafter, the card-reading coach goes to the play card and reads the "A/B" lines 6016. If the color of that talent lies under the "A" line 6017, then the coach will read the "A" paragraph 6018. Any one of the following is a possible result described in the "A" paragraph: a shot can be taken 6019; a shot can be taken on which the player is fouled 6020; a dunk can be made 6021; a layup can be made 6022; the rival's intensity changes 6023; or a pass and a shot by the player by whom the pass is received 6024. If a shot is taken 6019, or a fouled shot is taken 6020, or a pass and shoot 6024 is described, then the special shooting subroutine 7000 is followed. If either a layup 6022 or a dunk is the result described in paragraph A, then the flow of the game goes to block 1032 within shooting subroutine 1025.

Returning to block 6016, if the color of the relevant talent lies under "B" 6025, then the card reader will read paragraph "B" 6026. Any one of the following is possible result described by paragraph B: a shot can be taken 6027; a shot can be taken on which a foul is committed 6028; a ball can go out on the offense 6029; the defense can steal the ball 6030; a layup can be made 6031; a charging foul can be made 6032; or the offense can commit traveling 6033. If either a shot or a foul shot is taken 6027 or 6028, special shooting subroutine 7000 is followed. If the ball goes out on the offense, possession switches, and play resumes from box 1017. If the ball is stolen, an opportunity transition results, and play goes to block 6000. If a layup is made 6031, then play goes to box 1032 within shooting subroutine 1025. If the offense commits a charging foul 6032, then the defense gets possession of the ball 6034 (unless there is a bonus situation in which the defensive team shoots two free throws), and play continues at box 1039 within shooting subroutine 1025. If the offense commits traveling 6033, then possession switches at 1017.

Finally, special shooting subroutine 7000 is described. Subroutine 7000 begins by reading the area (circle, triangle, square, or three-point) from which the shot is to be taken 7001. The coach for the player with the ball then rolls the die and reads the number on the die which is the "base number" 7002. The offensive coach then goes to the shot matrix for the shooting player 7003 and reads the numeral given by the shot matrix in the row of the appropriate shooting area in the designated hotness column 7004. If the shot is to be modified, as would be described by the play card or play template 7005, then the base number is compared with the shot matrix number as modified. If the base number is less than or equal to the shot matrix number as modified 7006, then the shot is made 7007. If, however, the base number is greater than the shot matrix number as modified 7008, then the shot is missed and a rebound results. If, there was no suggestion on the play card or template that the shot matrix number need be modified, then the base number is compared to the unmodified shot matrix number. If the base number is less than or equal to the shot matrix number, then the shot is made 7007. If, however, the base number is greater than the shot matrix number 7010, then the shot is missed and a rebound results. If the shot is missed, the coaches consider whether the player was fouled on the shot 7011. If so, a free throw opportunity 7012 results. If not, the coach for the shooting player goes to the shot matrix for that player 7013, and changes the designated hotness column to one column closer to blue 7014. Because the shot was missed, a rebound results. Therefore, the card-reading coach reads the rebound line on the play card 7015. If the card indicates that the rebound is to the defense 7016, then an opportunity transition results, and play goes to subroutine 6000. If, however, the offense recovers the rebound 7017, then the play goes to box 1060 within shooting subroutine 1025. If a shot was made 7007, then the coach for the shooting player goes to the shot matrix for that player 7018 and changes the designated "hotness" column to one column closer to red 7019. If the player was fouled on the shot 7020, then the player has an opportunity to shoot a free throw 7012. If the player was not fouled on the shot, then play goes to box 1017 with possession switching. If a foul was committed during the shot 7029 or 7011, then a free throw path beginning with 7012 is applied. The coach for the shooting player rolls the die and reads the base number defined by the die 7030. That coach then goes to the shot matrix for that shooting player 7031 and reads the numeral given by the shot matrix for determining whether a free throw is made 7032. If the base number is less than or equal to the shot matrix free throw number 7033, then the free throw is made 7040. If a second free throw is due the player 7035, then play returns to box 7021 and another free throw is attempted. However, if a second free throw is not due the player, then possession switches and play begins again at 1017. If the base number was greater than the shot matrix free throw number 7036, then a normal transition situation results and play goes to normal transition subroutine 5000.

VIII. Other Board Games

An aspect of the basketball game discussed above is that the odds for making a basket change after each basket as a result of the outcome of the previous shot attempt. As discussed above, the game in this manner simulates the hot hand effect.

Similar streaks in performance are believed to occur in other sports as well. For example, hitters and pitchers in baseball are believed to have identifiable streaks during which their performance seems to be distinctly better or worse than their averages. Similarly, quarterbacks in football are believed to have streaks in which their passing performance is distinctly better than their average.

Accordingly, it is a further object of this invention to provide board games that simulate other sports in which the outcome of a particular activity reflects prior performance.

Specifically, a board game in contemplated for simulating a baseball game having at least one pitching figure for selectively throwing simulated pitches. Means of chance are provided for determining whether a simulated pitch passes across home plate in the strike zone. Further, means are provided for altering the odds of a simulated pitch being within the strike zone, with the odds-altering means being dependant upon whether the previous pitch was a strike or a ball or within an intended target area.

Additionally, a board game is contemplated for simulating a football game, having at least one quarterback figure for selectively throwing simulated passes. Means of chance are provided for determining whether the pass is received or not. Further, means for altering the odds of a simulated pass being received, with the odds-altering means being dependant upon whether a previous pass was caught or missed or whether a pass was thrown to an intended area, independent of receiver's ability to catch the ball.

It is to be understood that even though numerous characteristics and advantages in the present invention have been set forth in the foregoing description, together with details of the invention, the disclosure is illustrative only, and changes may be made in detail, especially in matters of shape, color, symbol choice, and so forth within the principles of the invention to the full extent indicated by the broad general meaning of the terms in which the independent claims are expressed. Also, within the present claims, the present game can be played on a board or electronically (e.g., video game).

It is claimed:

1. A basketball board game comprising:

a) a game board depicting a basketball court divided into a plurality of shooting areas, each said shooting area being associated with a symbol;

b) player figures representing basketball players selectively located on said board within said shooting areas;

c) a shot matrix associated with each said player figure, each said shot matrix having a plurality of columns and rows, each said shooting area being associated with one said row; each said row containing one number in each said column; one of said columns being selectively identified as a designated column and one said row being identified as a shooting row; said shooting row determined by location from which one said player figure is designated to shoot; and d) means of chance for determining a base number; such that during play, to determine whether a player figure makes or misses a basket, the base number as given by said means of chance can be compared to said number on said associated shot matrix lying within said shooting row and said designated column.

2. A basketball board game according to claim 1, wherein within each said row, the numbers vary from column to column, and wherein said designated column changes for a basketball player after said player has taken a shot.

3. A basketball board game according to claim 1, wherein within each said row, the numbers generally increase from left to right, and wherein said designated column moves one column to the right in the associated shot matrix after a player has made a shot and wherein said designated column moves one column to the left in the associated shot matrix after a player has missed a shot.

4. A basketball board game according to claim 1, wherein said number is from the set of integers from 1 to 12 inclusive, and wherein said chance means is adapted to select said base number from a set of integers from 1 to 12 inclusive.

5. A basketball board game according to claim 1, further comprising means to increase a player's odds of making a basket after that player has made a previous basket.

6. A basketball board game according to claim 1, wherein said player figures represent actual basketball players and wherein said player figures carry symbols representing basketball playing skills and said symbols being shaded colors which correspond to actual level of aptitude for a particular actual player for the associated skill.

7. A basketball board game comprising:

(a) player figures representing basketball players, said player figures carrying a plurality of symbols representing basketball playing skills, and each said symbol being shaded a color to represent the level of the player's aptitude for the associated skill;

(b) means for specifying one of said symbols to be used to determine the result of an action taken by one said basketball player during play of said game; and (c) means for determining an outcome of the action using said color of said specified symbol.

8. A basketball board game according to claim 7, wherein said player figures represent actual basketball players and wherein said symbol colors correspond to the actual level of skill for a particular actual player for the associated skill.

9. A basketball board game according to claim 7, wherein said symbol colors are assigned from a group of five colors and wherein said outcome determining means includes a talent converter dividing the five colors into two groups and specifying a first outcome associated with one said group, and specifying a second outcome associated with the other said group.

10. A basketball board game according to claim 7, further comprising play cards having rows corresponding to an action a basketball player having possession of a ball can make, and wherein said symbol specifying means includes symbols located within said play card rows, said play card symbols matching said player figure symbols, such that the presence of one said symbol on said play card specifies a player figure symbol.

11. A method of determining whether a player makes or misses a shot during play of a basketball board game, comprising the steps of:

a) providing a game board depicting a basketball court divided into a plurality of shooting areas, each shooting area being labeled with a symbol;

b) providing player figures representing basketball players, each said player figure being located within one said shooting area;

c) identifying one shooting player figure to attempt to shoot a basket;

d) providing a shot matrix associated with said player figure, said matrix having a plurality of columns and rows, each said shooting area being associated with one said row and said row being labeled with said symbol associated with said shooting area; each said row containing one number in each said column; one of said columns being identified as a designated column; and said row associated with said shooting area of said shooting player being identified as a shooting row;

e) providing means of selecting a number by chance;

f) activating said chance means to select a base number;

g) comparing said base number with said number located in said designated column in said shooting row to determine whether shot is made or missed; and h) after step (g), identifying another of said columns as said designated column, said identification being dependant upon whether the shot is indicated as made or missed.

12. A method according to claim 11, wherein if said base number is equal to or less than said number located in said shooting row and designated column, said player figure has made the shot.

13. A method of playing a simulated basketball game, comprising the steps of:

a) providing a game medium depicting a basketball court;

b) providing player figures representing basketball players;

c) providing means for selectively determining the odds of each player making a shot;

d) providing means of changing the odds of each player making a shot;

e) providing means of chance for use in selecting a base number;

f) providing comparison means for determining whether a player has made a shot, said comparison means specifying which numbers generated by said means of chance represent made shots and which numbers represent missed shots;

g) identifying one shooting player figure to attempt to shoot a basket;

h) activating said means of chance to generate a base number;

i) determining whether a player has made a shot as determined by said base number generated by said means of chance and by said comparison means; and j) after step i), if the player made the shot, increasing the odds of that player making the next shot or if the player misses the shot, decreasing the odds of that player making the next shot.

* * * * *

UNITED STATES PATENT AND TRADEMARK OFFICE
CERTIFICATE OF CORRECTION

PATENT NO. : 5,472,191 PAGE 1 of 2

DATED : December 5, 1995

INVENTOR(S) : Hendricks

It is certified that error appears in the above-identified patent and that said Letters Patent is hereby corrected as shown below:

Col. 1, line 29 "desireable" should read --desirable--

Col. 1, line 31 "desireable" should read --desirable--

Col. 2, line 62 "view" should read --views--

Col. 7, line 37 "1" should read in bold print

Col. 9, line 9 "1" should read in bold print

Col. 11, line 12 delete " " " after the word "card" (quotes)

Col. 12, line 34 "$\neq$" should read -- +3 --

Col. 13, line 7 "on" should read --in--

Col. 13, line 37 "C" should read --3--

Col. 14, line 5 "1" should read in bold print

Col. 14, line 17 "1" should read in bold print

Col. 14, line 57 "11" should read in bold print

Col. 15, line 12 insert --at-- after the word "switches"

UNITED STATES PATENT AND TRADEMARK OFFICE
CERTIFICATE OF CORRECTION

PATENT NO. : 5,472,191 PAGE 2 of 2

DATED : December 5, 1995

INVENTOR(S) : Hendricks

It is certified that error appears in the above-identified patent and that said Letters Patent is hereby corrected as shown below:

Col. 15, line 31 " 0 " should read --o--

Col. 17, line 33 "roles" should read --rolls--

Col. 17, line 39 "fooled" should read --fouled--

Col. 20, line 48 insert --at-- after the word "switches"

Col. 21, line 9 insert --at-- after the word "switches"

Col. 21, line 37 "1" should read in bold print

Col. 22, line 40 "TEAR" should read --TEAM--

Signed and Sealed this

Twenty-fourth Day of December, 1996

*Attest:*

Bruce Lehman

BRUCE LEHMAN

*Attesting Officer*

*Commissioner of Patents and Trademarks*